US009475626B2

(12) United States Patent
Coloneri et al.

(10) Patent No.: US 9,475,626 B2
(45) **Date of Patent: *Oct. 25, 2016**

(54) CONTAINER LID AND VALVE

(71) Applicant: LIQUISEAL LLC, Stony Brook, NY (US)

(72) Inventors: Antonio F. Coloneri, Stony Brook, NY (US); Jack Seidler, New York, NY (US)

(73) Assignee: LIQUISTOP LLC, Stony Brook, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/810,745

(22) Filed: Jul. 28, 2015

(65) Prior Publication Data

US 2015/0329254 A1 Nov. 19, 2015

Related U.S. Application Data

(63) Continuation-in-part of application No. 14/431,950, filed as application No. PCT/US2014/045228 on Jul. 2, 2014, now Pat. No. 9,296,532, which is a continuation-in-part of application No. PCT/US2014/010067, filed on Jan. 2, 2014.

(51) Int. Cl.

| | |
|---|---|
| ***B65D 1/34*** | (2006.01) |
| ***B65D 51/16*** | (2006.01) |
| ***B65D 43/02*** | (2006.01) |

(52) U.S. Cl.

CPC ..... *B65D 51/1644* (2013.01); *B65D 43/02* (2013.01); *B65D 43/0212* (2013.01); *B65D 2543/00046* (2013.01); *B65D 2543/00092* (2013.01); *B65D 2543/00296* (2013.01); *Y10T 29/49417* (2015.01); *Y10T 29/49421* (2015.01)

(58) Field of Classification Search

CPC ..... B65D 51/1672; B65D 51/1683
USPC ..... 220/714, 715, 711, 254.1; 215/260, 215/264, 265; 222/484, 482, 212
See application file for complete search history.

(56) References Cited

U.S. PATENT DOCUMENTS

| | | | | |
|---|---|---|---|---|
| 241,852 | A | 5/1881 | Everest | |
| 245,041 | A | 8/1881 | Wood | |
| 385,328 | A | 6/1888 | Straffin et al. | |
| 422,935 | A | 3/1890 | Hamsley | |
| 1,525,032 | A * | 2/1925 | Grady | B65D 47/248 137/862 |
| 3,208,629 | A | 9/1965 | Beeson | |
| 3,635,380 | A | 1/1972 | Fitzgerald | |
| 3,727,808 | A * | 4/1973 | Fitzgerald | B65D 47/248 220/715 |

(Continued)

*Primary Examiner* — Steven A. Reynolds
*Assistant Examiner* — King M Chu
(74) *Attorney, Agent, or Firm* — Preti Flaherty & Pachios LLP

(57) ABSTRACT

A lid for use with a fluid container includes a body member and a valve. The body member defines an aperture and includes a central portion that extends to an outer periphery configured to couple to a rim of a fluid container. In one embodiment, the body member and the valve and connected by an interconnecting portion which are formed as an integral single piece structure. The valve has a first portion directly secured to the bottom surface of the body member and a second free end portion that extends from the first portion. The second free end portion includes a protuberance and is movable relative to the first portion between a free state in which the protuberance seals the aperture and a depressed state obtained in response to downward deflection of the central portion of the body member relative to the outer periphery in which the aperture is unsealed.

21 Claims, 23 Drawing Sheets

(56) References Cited

U.S. PATENT DOCUMENTS

| | | | | |
|---|---|---|---|---|
| 3,730,399 | A * | 5/1973 | Dibrell | B65D 47/2018 220/715 |
| 3,739,938 | A * | 6/1973 | Paz | A47G 19/2272 215/309 |
| 3,972,443 | A | 8/1976 | Albert | |
| 4,099,642 | A | 7/1978 | Nergard | |
| 4,133,446 | A | 1/1979 | Albert | |
| 4,136,799 | A * | 1/1979 | Albert | B65D 47/249 215/315 |
| 4,138,033 | A | 2/1979 | Payne et al. | |
| 4,184,603 | A | 1/1980 | Hamilton, Sr. | |
| 5,485,938 | A | 1/1996 | Boersma | |
| 5,702,025 | A | 12/1997 | Di Gregorio | |
| 5,706,972 | A | 1/1998 | Sousa | |
| 6,062,419 | A | 5/2000 | Kruger et al. | |
| 6,386,404 | B1 | 5/2002 | Auer | |
| 7,954,659 | B2 | 6/2011 | Zuares et al. | |
| 7,959,029 | B2 | 6/2011 | Whitaker et al. | |
| 8,272,525 | B1 | 9/2012 | La Torre et al. | |
| 8,297,462 | B1 | 10/2012 | Joyce | |
| 2002/0148845 | A1 | 10/2002 | Zettle et al. | |
| 2003/0094467 | A1 | 5/2003 | Dark | |
| 2010/0059535 | A1 | 3/2010 | Syrkos | |
| 2010/0102060 | A1 | 4/2010 | Ruse, Jr. | |
| 2012/0037651 | A1 | 2/2012 | Steuer | |

* cited by examiner

FIG. 19
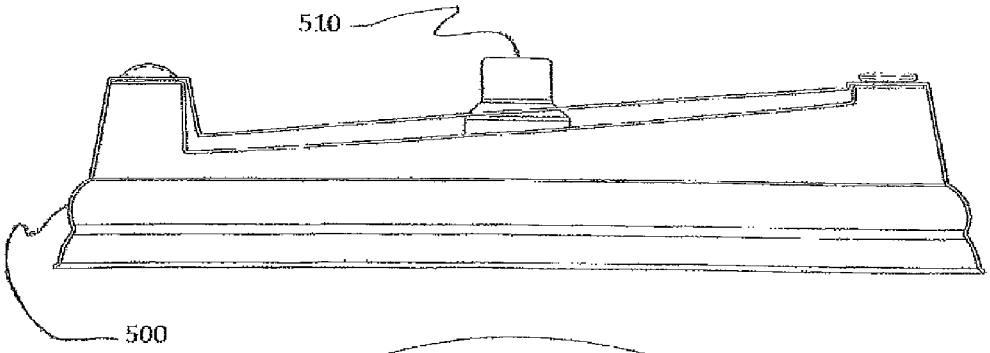
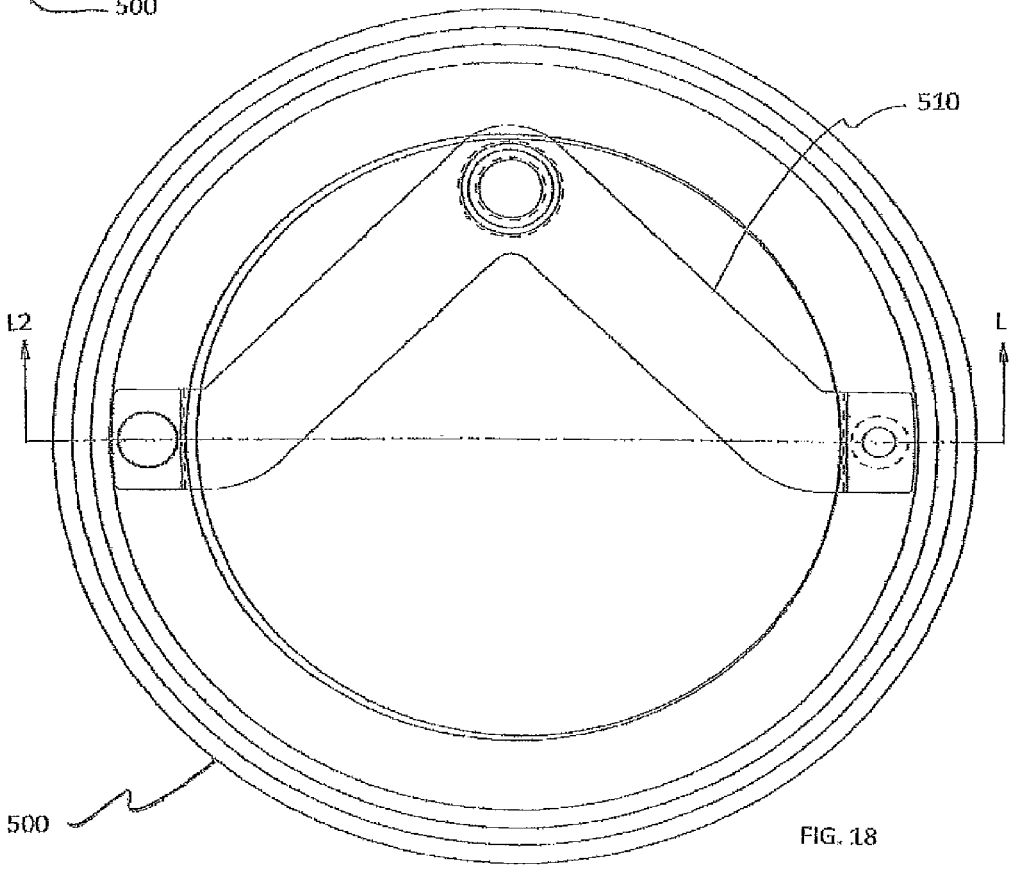
FIG. 18

CONTAINER LID AND VALVE

TECHNICAL FIELD

The present disclosure relates to fluid controlling devices and, more particularly, container lids and valves configured to couple to an open top of a fluid container such as a beverage cup to selectively seal fluid within the fluid container.

BACKGROUND

It has long been known in the prior art to enclose a container such as a cup with a lid selectively mounted to a rim of the cup. For example, lift-tabs or the like may be utilized to provide an opening in the lid for dispensing fluid contained within the cup. The lift-tab is typically perforated to allow a user to fold the lift-tab and secure the lift-tab to a corresponding protuberance provided on a top surface of the lid. However, one problem associated with the lift-tab type lids is that they are not resealable after having been folded.

In comparison, known resealable container lids typically include complex mechanical mechanisms that are often an assembly of several distinct elements. As such, the known resealable container lids can be mechanically complicated, difficult to use, and/or are relatively expensive to manufacture.

SUMMARY

An aspect of the present disclosure provides a lid configured for use with a fluid container. The lid includes a body member including an outer periphery configured to couple to a rim of a fluid container. The body member defines a pair of apertures that extend through the body member. The body member may be detachably couplable to the fluid container. A valve operably coupled to an interior/bottom surface of the body member includes a pair of protuberances that are configured to selectively engage the pair of apertures. Each protuberance is in registration with one of the pair of apertures. Depression of one of the protuberances moves the pair of protuberances out of sealed engagement with the pair of apertures for dispensing fluid contained within the fluid container. The pair of protuberances may be in vertical registration with the pair of apertures so as to extend parallel to a longitudinal axis that is defined through the fluid container.

The valve may include a generally elliptical configuration that has side portions at opposite ends of a major axis defined through the valve and top and bottom portions at opposite ends of a minor axis defined through the valve. The side portions of the valve may be configured to flex as a result of depressing one or both of the pair of protuberances to enable the pair of protuberances to be spring loaded and to form a fluid tight seal with surfaces of the body member when the pair of protuberances are positioned within the pair of apertures. The top portion of the valve may be thinner and/or thicker than the bottom portion to provide the valve with a suitable flexibility. In embodiments, the top portion of the valve may be spaced apart from the interior surface of the body member to facilitate a sealed engagement between the pair of protuberances and the apertures when the valve is coupled to the interior surface of the body member. In certain embodiments, the top portion of the valve may be configured to rest on the interior surface of the body member.

A mounting bracket may be operably coupled to the interior surface of the body member. The mounting bracket contacts the bottom portion of the valve to couple the valve to the interior surface of the body member such that both protuberances are depressible for dispensing fluid through one or both of the pair of apertures. Alternatively, the mounting bracket may be operably coupled to the interior surface of the body member and in contact with the bottom portion of the valve to couple the valve to the interior surface of the body member such that one of the protuberances is depressible for dispensing a fluid from the aperture in registration with the other protuberance. The mounting bracket may be mechanically coupled to the lid, for example, via at least one biocompatible adhesive. In embodiments, the mounting bracket may be integrally formed with the body member.

Each of the apertures may be provided in a corresponding recess provided on the body member of each lid. In embodiments, the corresponding recesses and/or apertures are positioned on the body member in a diametrically opposite relationship relative to one another. The corresponding recesses may be configured to receive a corresponding one of the pair of protuberances therein so as to allow depression thereof by the user. The corresponding recesses may have a generally circumferential configuration. Additionally, a generally elongated recess may be provided on the body member and positioned between the pair of corresponding recesses so as to allow stacking of a plurality of lids and to save space. In embodiments, the generally elongated recess is configured to enable adjacently stacked lids to be radially offset, for example, approximately 90 degrees.

According to one aspect, the lid includes a body member including an outer periphery configured to couple to a rim of a fluid container. The body member defines a pair of apertures extending through the body member. The body member may be detachably couplable to the fluid container. A valve operably couples to an interior surface of the body member and includes a pair of depressible protuberances disposed in selective sealed engagement with the pair of apertures so as to prevent dispensing of a fluid from the fluid container. A mounting bracket operably couples to an interior surface of the body member and is configured to couple the valve to the body member. The pair of protuberances is configured such that depression of one of the pair of protuberances moves the pair of protuberances out of sealed engagement with the pair of apertures for dispensing a fluid of the fluid container. Each of the pair of protuberances may be in vertical registration with one of the pair of apertures so as to extend parallel to a longitudinal axis that is defined through the fluid container.

The valve may include a generally elliptical configuration that has side portions at opposite ends of a major axis defined through the valve and top and bottom portions at opposite ends of a minor axis defined through the valve. The side portions of the valve may be configured to flex as a result of depressing one or both of the pair of protuberances to enable the pair of protuberances to be spring loaded and to form a fluid tight seal with surfaces of the body member when the pair of protuberances are positioned within the pair of apertures. The top portion of the valve may be thinner and/or thicker than the bottom portion to provide the valve with a suitable flexibility. In embodiments, the top portion of the valve may be spaced apart from the interior surface of the body member to facilitate a sealed engagement between the pair of protuberances and the apertures when the valve is coupled to the interior surface of the body member. In certain embodiments, the top portion of the valve may be configured to rest on the interior surface of the body member.

A mounting bracket may be operably coupled to the interior surface of the body member and in contacting relationship with the bottom portion of the valve to couple the valve to the interior surface of the body member such that both protuberances are depressible for dispensing a fluid from the aperture in registration with the other protuberance. Alternatively, the mounting bracket may be operably coupled to the interior surface of the body member and in contacting relationship with the bottom portion of the valve to couple the valve to the interior surface of the body member such that one of the protuberances is depressible for dispensing a fluid from the aperture in registration with the other protuberance. The mounting bracket may be coupled to the lid via one or more biocompatible adhesives.

Each of the apertures may be provided in a corresponding recess provided on the body member. The corresponding recesses may be configured to receive a corresponding one of the pair of protuberances therein so as to allow depression thereof by the user. The corresponding recesses may have a generally circumferential configuration. Additionally, a generally elongated recess may be provided on the body member and positioned between the pair of corresponding recesses so as to allow stacking of a plurality of lids.

According to one aspect, the present disclosure relates to a lid configured for use with a fluid container and includes a body member and a valve. The body member includes a central body that extends to an outer periphery configured to couple to a rim of a fluid container. The body member defines an aperture therethrough and has a top surface and a bottom surface.

The valve has a first portion directly secured to the bottom surface of the body member and a second portion that extends from the first portion. The second portion includes a protuberance and is movable relative to the first portion between a free state and a depressed state in response to deflection of at least a portion of the central body of the body member relative to the outer periphery of the body member. The first portion may be disposed transverse to the second portion in at least one of the free state and the depressed state. The first portion may be parallel to the second portion in at least one of the free state and the depressed state.

The protuberance is configured for sealed engagement with the aperture of the body member while the second portion is in the free state. The protuberance is spaced from the aperture of the body member while the second portion is in the depressed state. The protuberance may include a tapered surface. The tapered surface may be disposed in the aperture of the body member while the second portion of the valve is in the free state to seal the aperture. The tapered surface may extend through the aperture of the body member in the free state.

In embodiments, the second free end portion includes a section configured to contact the bottom surface of the body member. The deflection of the central body deflects the second free end portion downward such that the second free end portion pivots relative to the first portion between the free state and the depressed state.

The bottom surface of the central body may contact a top surface of the second portion of the valve to move the second portion from the free state to the depressed state in response to the deflection of the central body. The bottom surface of the central body may be spaced from the top surface of the second portion while the second portion is in the free state. The bottom surface of the central body may be in contact with the top surface of the second portion while the second portion is in the depressed state.

In embodiments, the central body includes a nub that extends from the top surface of the body member. The nub may be deflectable relative to the central body to move the second portion between the free state and the depressed state.

In some embodiments, the valve includes at least one rib along a portion thereof. The valve may include at least two ribs disposed in parallel relation.

In certain embodiments, the first and second portions of the valve may be connected by a hinged portion. The hinged portion may include at least one bend to orient the second portion relative to the first portion.

In embodiments, the first portion may be heat sealed to the bottom surface of the body member. In some embodiments, the first portion is ultrasonically welded to the bottom surface of the body member.

In one aspect, a valve for a container lid is provided. The valve is adapted to directly secure to a container lid and includes a protuberance, wherein upon securement of the valve to the container lid, the protuberance is configured to selectively disengage from sealed engagement with an aperture defined in the container lid in response to a deflection of a central body of the container lid relative to an outer periphery of the container lid.

The valve may include a first portion and a second portion. The second portion may be movable relative to the first portion and supports the protuberance. In embodiments, the second portion includes a second protuberance configured to contact a bottom surface of the central body of the container lid to enable the second portion to move relative to the first portion.

In embodiments, the valve includes at least one rib along a portion thereof. The valve may include a hinged portion that connects the first and second portion. The hinged portion can include at least one bend.

In embodiments, the body member and the valve may be connected by an interconnecting portion and the body member, the valve and the interconnecting portion may be fabricated as a single piece integral unit.

Other aspects, features, and advantages will be apparent from the description, drawings, and the claims

BRIEF DESCRIPTION OF THE DRAWINGS

Various embodiments of the present disclosure are described hereinbelow with references to the drawings, of which:

FIG. 18 is a bottom view of one embodiment of a lid according to the present disclosure;

FIG. 19 is a side cross-sectional view of the lid of FIG. 18 taken along line segment L2-L2 of FIG. 18;

DETAILED DESCRIPTION

As used herein, the terms "proximal" or "trailing" refer to the portion of a structure that is closer to a user, while the terms "distal" or "leading" refer to the portion of a structure that is farther from the user.

Figure 1:
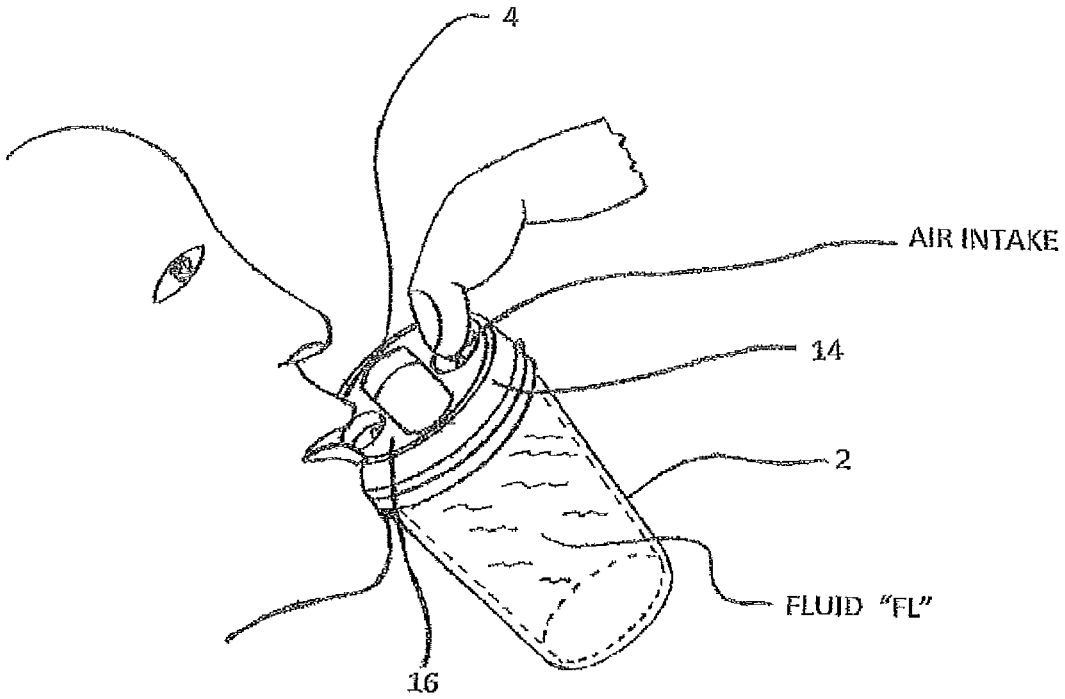
FIG. 1 is a perspective view of a user drinking from a fluid container including a lid according to an embodiment of the instant disclosure.

FIG. 1 is a perspective view of a fluid container 2 that utilizes a lid 4 according to an embodiment of the instant disclosure. In accordance with the instant disclosure, the lid 4, which defines a central axis "A-A" therethrough, enables a user to selectively dispense a fluid "FL" from fluid container 2 while maintaining a sealed engagement therewith when not dispensing fluid "FL" to prevent inadvertent spilling of the fluid "F."

Fluid container 2 may be made from any suitable material including, but not limited to, plastic, paper, glass, metal, ceramic, closed-cell extruded polystyrene foam, cardboard, etc. Although fluid container 2 may have any suitable configuration, fluid container 2 is shown, for illustrative purposes, as a typical paper/cardboard cup utilized, for example, by most restaurants, coffee houses, etc.

Figure 2:
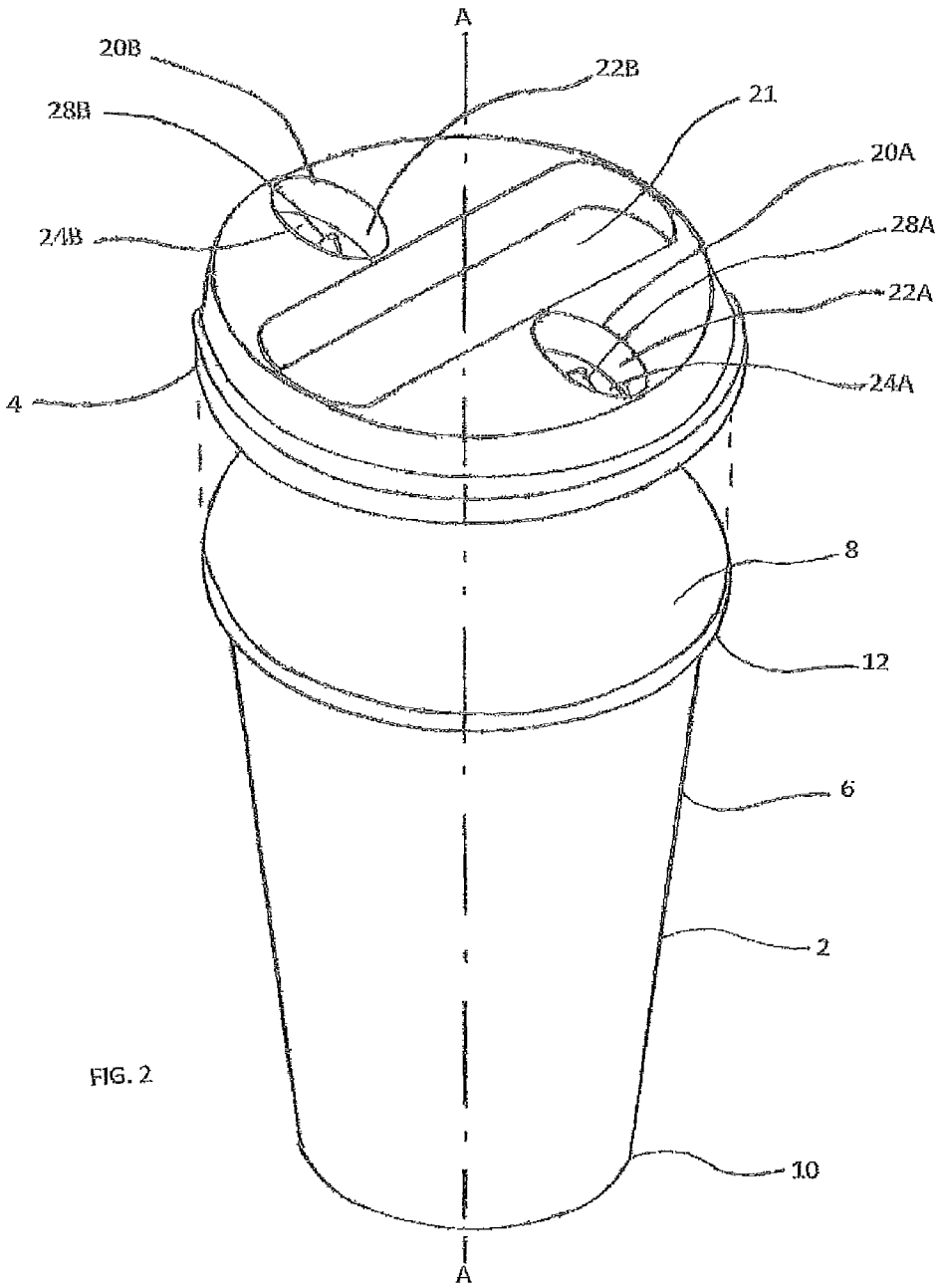
FIG. 2 is an exploded view of the fluid container and the lid depicted in FIG. 1.

Fluid container 2 includes a generally cylindrical configuration having an open top end 6 and closed bottom end 10 (FIG. 2). As appreciated, open top end 6 defines an opening 8. A flange or rim 12 extends along a peripheral edge that defines opening 8 and is configured to facilitate detachable engagement between fluid container 2 and lid 4. It is within the purview of the present disclosure; however, that lid 4 may be non-detachably or fixedly secured to fluid container 4 and movable with respect thereto from an open configuration for filling fluid container 2 with one or more suitable fluids to a closed, sealed configuration for containing and selectively dispensing fluid "FL." In this particular embodiment, one or more hinge configurations may be utilized to couple lid 4 to fluid container 2. Those skilled in the art will appreciate other coupling methods that may be utilized to couple lid 4 and fluid container 2 to one another.

Figure 3:
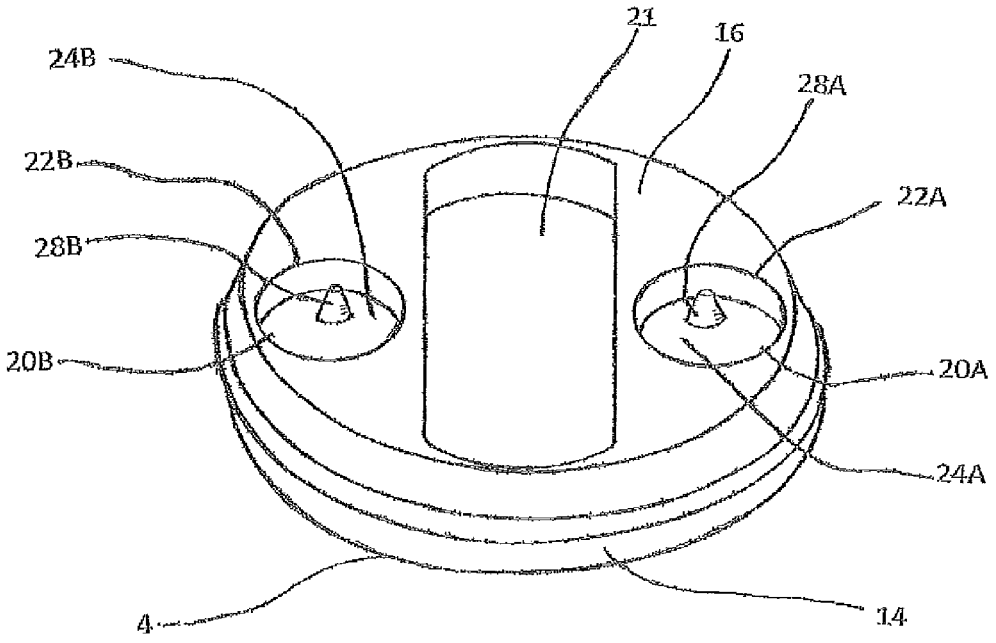
FIG. 3 is a perspective view of the lid of FIGS. 1 and 2.
Figure 4:
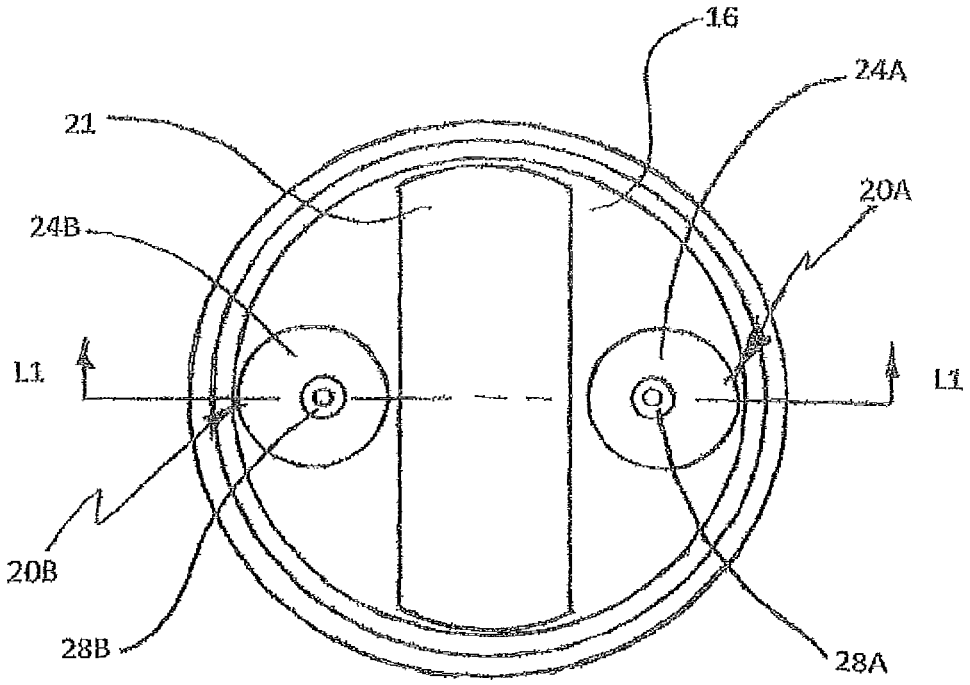
FIG. 4 is a top elevational view of the lid of FIGS. 1-3.

Referring to FIG. 3, lid 4 is illustrated. Lid 4 may be formed from any suitable material, including the materials mentioned above with respect to fluid container 2. For illustrative purposes, lid 4 is shown formed from a relatively soft plastic. In some embodiments, however, lid 4 may be made from a relatively hard plastic. As can be appreciated, in the former instance, lid 4 may disposable, and in the latter instance, lid 4 may be reusable, e.g., lid 4 may be used and, subsequently, cleaned for future use. In either instance, lid 4 provides a simple and convenient method for dispensing fluid from fluid container 2. Moreover, when fluid "FL" is not being dispensed from fluid container 2, lid 4 is in sealed engagement with fluid container 2 so as not to allow fluid "FL" to escape therefrom, i.e., fluid container 2 is spill proof under normal operation, e.g., held by a user in a pre-dispensing configuration.

Continuing with reference to FIG. 3, lid 4 includes a body 14 of suitable configuration for attaching to fluid container 2. In the illustrated embodiment, body 14 is shown having a generally circumferential configuration with an outer surface 16 including a plurality of recesses thereon. Specifically, a pair of opposing recesses 20*a*, 20*b* (FIGS. 3-7) of any suitable configuration are formed on outer surface 16 and are configured to receive a portion of a finger of a user therein. Recesses 20*a*, 20*b* are shown having a generally circumferential configuration defined by sidewalls 22*a*, 22*b* and a bottom wall 24*a*, 24*b*, respectively (FIGS. 3-7). Recesses 20*a*, 20*b* may be utilized as a reservoir for dispensed fluid "FL" to prevent inadvertent dribbling as fluid "FL" is being dispensed from apertures 26*a*, 26*b* and into a user's mouth (see, e.g., FIG. 1). Moreover, an optional, generally elongated recess 21 of suitable configuration may be provided between recesses 20*a*, 20*b*. Recess 21 may be configured to allow stacking of lid 2, thereby facilitating packaging of lid 4, for example, when lid 4 is purchased and sold in large quantities to vendors.

A pair of corresponding apertures 26*a*, 26*b* (FIGS. 6 and 8) of suitable configuration are defined through respective bottom walls 24*a*, 24*b* and are configured to selectively receive therein a pair of corresponding protuberances 28*a*, 28*b* provided on a valve 30. Specifically, apertures 26*a*, 26*b* include a generally circumferential configuration that is configured for sealed engagement with a generally conical surface provided on corresponding protuberances 28*a*, 28*b*, see FIGS. 5-8 and 10 for example. In this sealed engagement, fluid "FL" from fluid container 2 is prevented from being dispensed therefrom.

In accordance with the instant disclosure, body 14 is formed with a thickness of plastic that provides a suitable rigidity to body 14. Specifically, body 14 should have a thickness that prevents substantial deformation thereof when lid 4 is manipulated by a user. More specifically, bottom walls 24*a*, 24*b* should be rigid or sturdy enough so as not to deform when protuberances 28*a*, 28*b* are in sealed engagement with apertures 26*a*, 26*b*. As can be appreciated, if bottom walls 24*a*, 24*b* are not sufficiently thick, there exists the likelihood that bottom walls 24*a*, 24*b* may deform when protuberances 28*a*, 28*b* are in a sealed engagement therewith, which, in turn, may result in a seal between protuberances 28*a*, 28*b* and apertures 26*a*, 26*b* becoming compromised.

Figure 7:
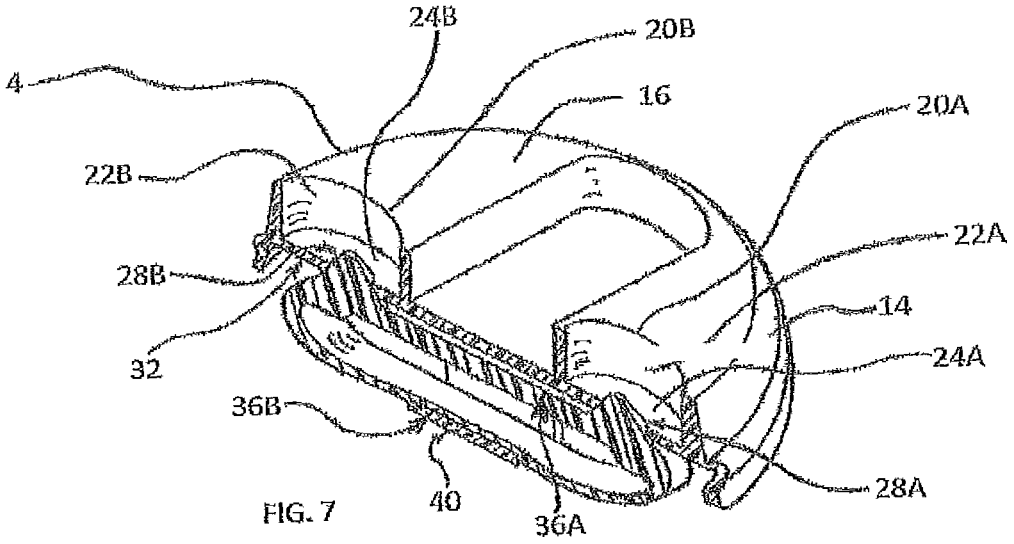
FIG. 7 is a cross-sectional, perspective view of the lid of FIGS. 1-4.
Figure 8:
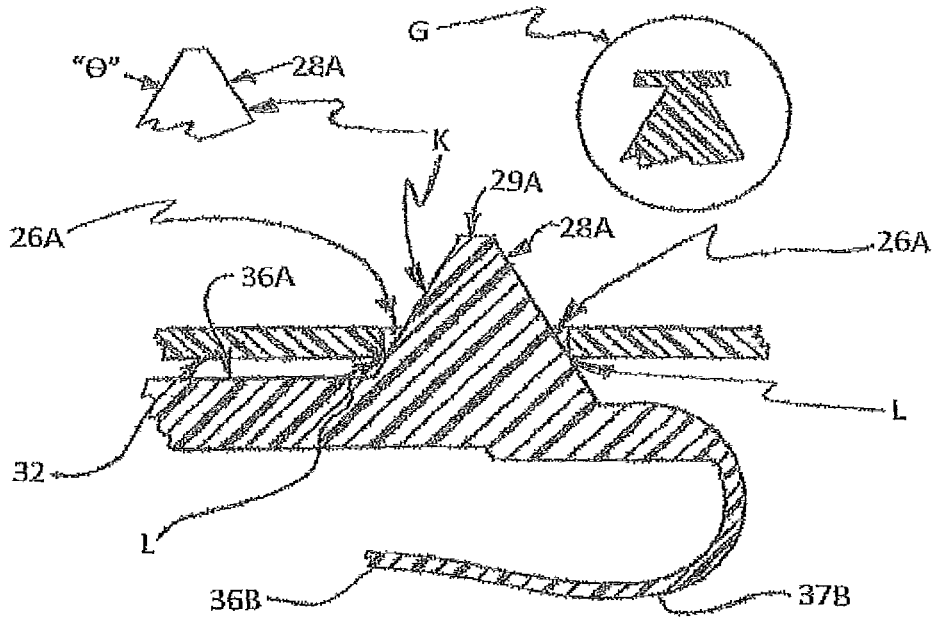
FIG. 8 is a partial, cross-sectional view of the lid of FIGS. 1-4 illustrating the valve shown in the closed configuration.
Figure 9:
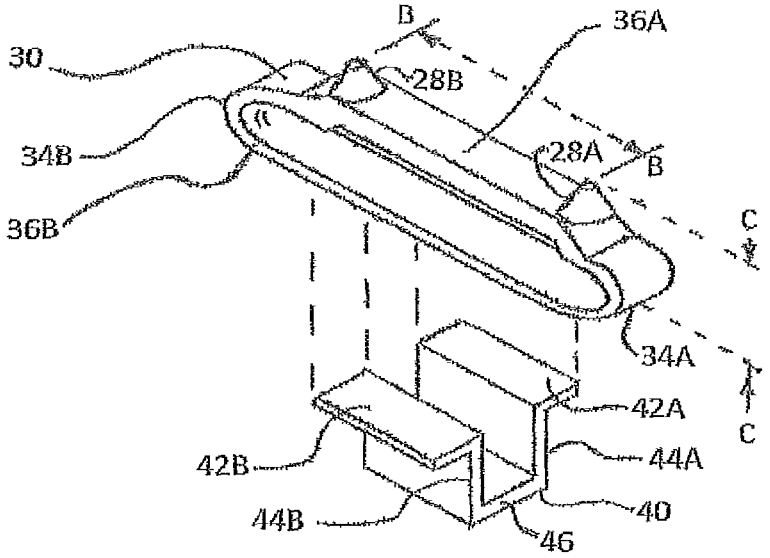
FIG. 9 is a perspective view, with parts separated, of the valve and a mounting bracket of the lid of FIGS. 1-4.

Referring to FIGS. 5-10, valve 30 couples to an interior surface 32 of body 14 and is configured to allow selective dispensing of fluid "FL" contained within fluid container 2 when lid 4 is coupled thereto. With this purpose in mind, valve 30 may be made from any suitable biocompatible material (e.g., plastic) and includes a generally elliptical configuration having side portions 34*a*, 34*b* at opposite ends of a major axis "B-B" defined through valve 30 and top and bottom portions 36*a*, 36*b* are disposed at opposite ends of a minor axis "C-C" defined through valve 30, as best seen in FIG. 9. Side portions 34*a*, 34*b* are configured to flex as a result of depressing one or both of protuberances 28*a*, 28*b*. For example, when protuberance 28*a* is depressed and removed out of sealed engagement with aperture 26*a*, valve 30 flexes about side portion 34*a*, which, in turn, causes protuberance 28*b* to move out of sealed engagement with aperture 26*b* such that fluid "FL" can be dispensed from fluid container 2 through aperture 26*b*, see FIGS. 1 and 6. As can be appreciated, the same effect, with the obvious differences being taken into consideration, is achieved when protuberance 28*b* is depressed. Further, in embodiments, although valve 30 may be shown in some of the figures with only two opposing side portions 34*a*, 34*b*, valve 30 may have any suitable number of side portions. For example, the valve 30 may have three or more side portions (e.g., Y-shaped with 3 side portions, star-shaped with 5 side portions, etc.). Moreover, each of these side portions may have any number of protuberances that are movably disposed in registration with any number of apertures defined within the body member of the lid at any number of locations about the body member. Each side portion may be integrally formed and/or mechanically coupled to one or more of the other side portions by any suitable securement process such as welding, fastening, adhesive, etc.

In accordance with the instant disclosure, the depressed protuberance provides a vent that facilitates dispensing fluid from lid 4 through the opposing aperture. More particularly, for example, when protuberance 28*a* is depressed and fluid container 2 is tilted for dispensing fluid through aperture 26*b*, aperture 26*a* vents air therethrough, which, in turn, provides a smooth, steady flow of fluid "FL" through aperture 26*b* and across sidewall 22*b* of recess 20*b* (see FIG. 1).

Figure 5:
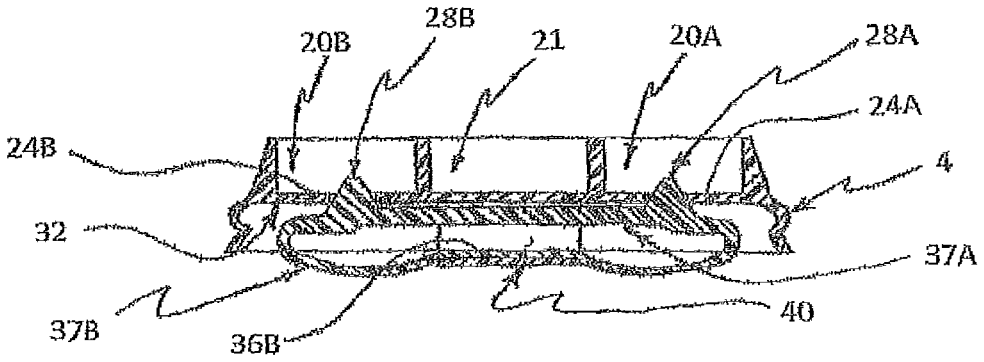
FIG. 5 is a cross-sectional view of the lid of FIGS. 1-4 taken along line segment L1-L1 of FIG. 4 with a valve of the lid being illustrated in a closed configuration.

Top portion 36*a* of valve 30 may have any suitable thickness when compared to bottom portion 36*b* to provide valve 30 with any suitable flexibility sufficient to enable stable movement and selective sealing engagement of the protuberance(s) with the corresponding aperture(s). For example, top portion 36*a* may be thicker than bottom portion 36*b* to facilitate movement of protuberances 28*a*, 28*b* into and/or out of sealed engagement with apertures 26*a*, 26*b* when either of protuberances 28*a*, 28*b* is depressed and/or released. In embodiments, top portion 36*a* is configured to be spaced from interior surface 32 of body member 4 to facilitate a sealed engagement between protuberances 28*a*, 28*b* and apertures 26*a*, 26*b* when valve 30 is coupled to body 14 (FIGS. 5 and 7). In certain embodiments, top portion 36*a* is configured to engage and/or rest against the interior 32 of body member 4. Additionally, top portion 36*a* may be slanted upwardly from valve 30 to ensure that protuberances 28*a*, 28*b* remain in sealed engagement with apertures 26*a*, 26*b* when protuberances 28*a*, 28*b* are not depressed (see, e.g., FIG. 9). The upward slanting of top portion 36*a* may also facilitate manufacturing.

As discussed above, bottom portion 36*b* of valve 30 may have any suitable thickness relative to top portion 36*a* to provide suitable flexibility to valve 30 sufficient to enable stable movement and selective sealing engagement of the protuberance(s) with the corresponding aperture(s). For example, bottom portion 36*b* may be thinner than top portion 36*a* to facilitate movement of protuberances 28*a*, 28*b* into and/or out of sealed engagement with apertures 26*a*, 26*b* when either of protuberances 28*a*, 28*b* is depressed and/or released. Specifically, a mounting bracket 40 extends across a medial portion 38 of bottom portion 36*b* and is utilized to couple valve 30 to interior surface 32 of body 14. In the assembled configuration, medial portion 38 is pressed towards interior surface 32 and forms two bowed portions 37*a*, 37*b* that provide a suitable biasing force that is configured to bias protuberances 28*a*, 28*b* into sealed engagement with apertures 26*a*, 26*b*. In accordance with the instant disclosure, a balance (equilibrium) between a thickness of bottom walls 24*a*, 24*b* and a biasing force provided by bowed portions 37*a*, 37*b* is needed to ensure that the biasing force of the bottom portion 36*b* does not deform or otherwise alter the apertures 24*a*, 24*b*. As can be appreciated, such a balance may be acquired via rudimentary calculations.

Mounting bracket 40 may take on any suitable configuration to achieve the purposes described herein (FIG. 9). In the illustrated embodiment, for example, mounting bracket 40 includes a "C" shape with two opposing flanges 42*a* 42*b* that are spaced apart from one another by a distance that is slightly greater than a width of bottom portion 36*b*. A pair of sidewalls 44*a*, 44*b* extend from flanges 42*a*, 42*b* and meet a base portion 46 that is configured to contact medial portion 38 of bottom portion 36*b*. Flanges 42*a*, 42*b* may couple to interior surface 32 of body 14 via any suitable coupling methods, e.g., a biocompatible adhesive or the like. In embodiments, such as, for example, when lid 4 is reusable, an alternate type of mounting configuration may be utilized for securing valve 30 to lid 4.

Protuberances 28*a*, 28*b* may include any suitable configuration including sides, or portions thereof, that are slanted at any suitable angle and/or sides, or portions thereof, that are not slanted (e.g., perpendicular to body member). As noted above, protuberances 28*a*, 28*b* can include a conical configuration to enable spill proof sealing when the sides of the protuberances are positioned in engagement with the surfaces of the lid that define the apertures. As shown in FIG. 8, sides K of protuberances 28*a*, 28*b* are angled to intersect at an angle "θ" relative to axis "D-D." Angle "θ" may be any suitable angle, e.g., angle "θ" may range from between about 1 degree to about 90 degrees. As appreciated, any of the dimensions of the protuberances, e.g., diameter, height, etc., may be arranged to accommodate different aperture diameters to provide selective sealing engagement of the outer surface of one or both of the protuberances 28*a*, 28*b* with one or both of the aperture 24*a*, 24*b*. For example, dimensions of the protuberance(s) can be configured such that the protuberance(s) seal with the aperture(s) at a predetermined location L along sides K of the protuberance. In embodiments, the outer surface of the protuberance(s) and the inner surfaces of the body member that define the aperture(s) form an annular seal at the location L.

In the illustrated embodiment, protuberances 28*a*, 28*b* have a relatively blunt tip 29*a*, 29*b*, see FIGS. 8-9. Alternatively, protuberances 28*a*, 28*b* may each include a blunt tip 29*a*, 29*b* that is ergonomically configured to accommodate various finger sizes (see area of detail "G" in FIG. 8 for example).

Figure 6:
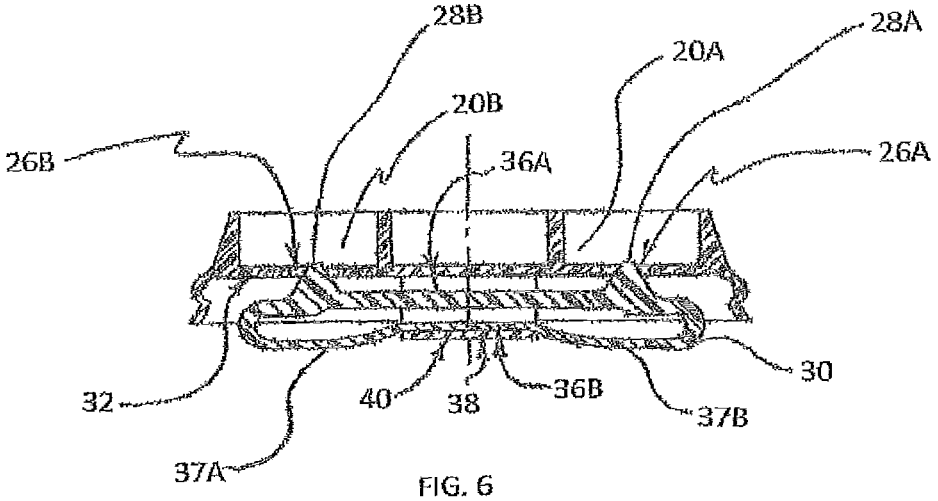
FIG. 6 is a cross-sectional view of the lid of FIGS. 1-4 taken along line segment L1-L1 of FIG. 4 with the valve of the lid being illustrated in an open configuration.
Figure 10:
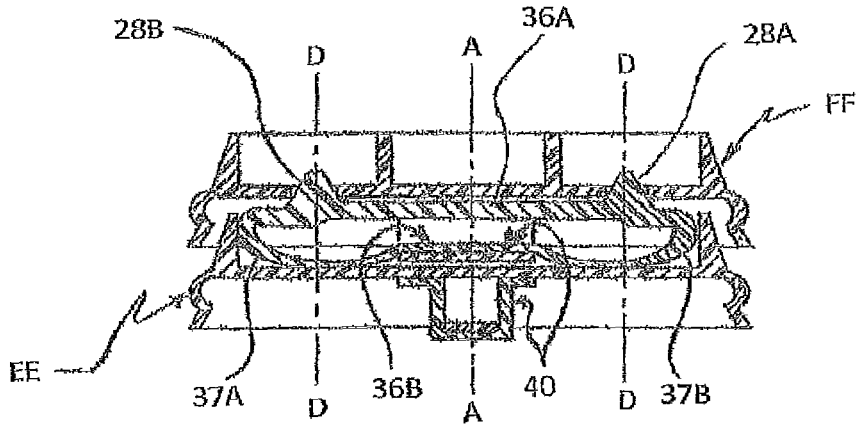
FIG. 10 is a cross-sectional view of two of the lids of FIGS. 1-4 in a stacked configuration.

Protuberances 28*a*, 28*b* are configured such that depression of one of the protuberances, e.g., protuberance 28*a*, moves both of protuberances 28*a*, 28*b* out of sealed engagement with apertures 26*a*, 26*b* such that fluid "FL" may be dispensed from fluid container 2, see FIG. 6. In an assembled configuration, protuberances 28*a*, 28*b* are in vertical registration with apertures 26*a*, 26*b* so as to extend along an axis "D-D" that is parallel to the longitudinal axis "A-A" defined through lid 2 (FIG. 10). It has been found that positioning protuberances 28*a*, 28*b* within apertures 26*a*, 26*b* in this fashion provides a tight seal therebetween. In embodiments, however, protuberances 28*a*, 28*b* may be positioned within apertures 26*a*, 26*b* so as to extend non-parallel to longitudinal axis "A-A."

Operation of fluid container 2 including a lid 4 is described herein. For illustrative purposes, it is assumed fluid "FL" has been previously provided into fluid container 2 and lid 4 is secured thereto to form a seal around fluid container 2. Moreover, it is assumed that protuberances 28*a*, 28*b* are oriented parallel to axis "D-D."

With lid 4 secured to fluid container 2, protuberances 28*a*, 28*b* are in sealed engagement with apertures 26*a*, 26*b* so as to prevent inadvertent dispensing of the fluid "FL" from fluid container 2. To dispense fluid "FL" contained within fluid container 2, a user may depress one of protuberances 28*a*, 28*b*, e.g., protuberance 28*b*. In doing so, protuberance 28*b* moves out of sealed engagement with aperture 26*b*, which, in turn, causes protuberance 28*a* to move out of engagement with aperture 26*a* (see FIG. 6 for example). Thereafter, a user may move fluid container 2 to a position for consuming the fluid "FL", see FIG. 1 for example.

The unique configuration of lid 4 including valve 30 overcomes the aforementioned drawbacks that are typically associated with conventional lids. That is, lid 4 is simple to operate and is relatively inexpensive to manufacture when compared to conventional lids.

From the foregoing and with reference to the various figure drawings, those skilled in the art will appreciate that certain modifications can also be made to the present disclosure without departing from the scope of the same. For example, while lid 4 has been described herein as utilizing valve 30 that includes two protuberances 28*a*, 28*b* that may be depressed for dispensing fluid "FL" from fluid container 2, other configurations of valve 30 may also be utilized.

Figure 11:
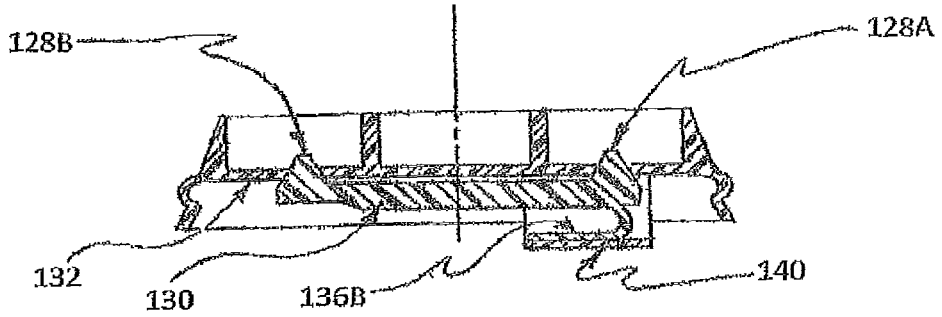
FIG. 11 is a cross-sectional view of another lid according to one embodiment of the present disclosure.

With reference to FIG. 11, an alternative embodiment of a lid is illustrated and designated 104. Lid 104 includes valve 130 having a bottom portion 136*b* that provides a suitable biasing force that is configured to bias protuberances 128*a*, 128*b* into sealed engagement with corresponding apertures (not explicitly shown in FIG. 11). Moreover, a mounting bracket 140 is configured to mount valve 130 to an interior of lid 104 by one or more suitable fastening techniques, e.g., an adhesive, and is configured to couple to bottom portion 136*b* (e.g., by an adhesive).

Operation of lid 104 is similar to lid 4, unlike lid 4; however, only one of protuberances 128*a*, 128*b* is configured to dispense fluid "FL" from the fluid container. Protuberance 128*b* is configured to dispense fluid "FL" from the fluid container when protuberance 128*a* is depressed. Depressing protuberance 128*b* does not cause protuberance 128*a* to move out of sealed engagement with the corresponding aperture. Therefore, this embodiment only allows dispensing of fluid "FL" on one side only.

In accordance with the present disclosure, embodiments of the valve can be directly coupled to an interior or bottom surface of embodiments of the presently disclosed lids by any suitable fastening technique known in the art, e.g., heat sealing, welding such as ultrasonic welding, adhesive, crimping, snap fit, etc., and/or combinations thereof. In certain embodiments, the valve can be integrally and/or monolithically formed with any one of the presently disclosed lids.

Figure 12:
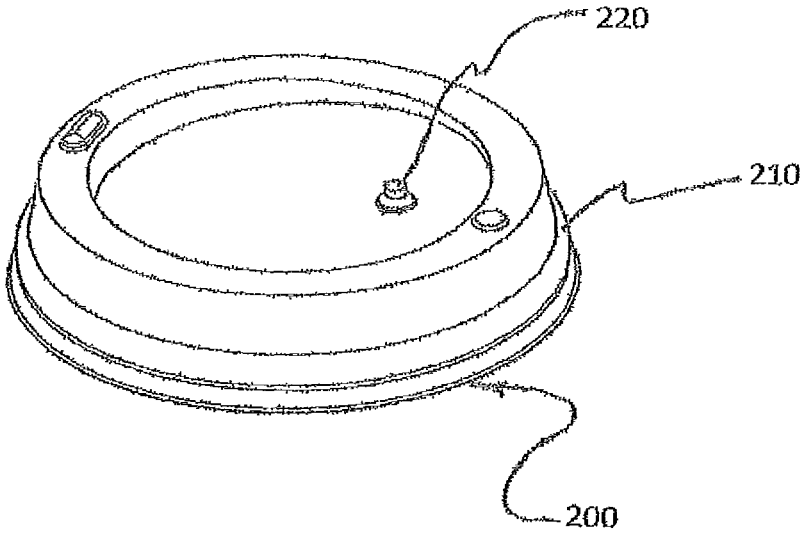
FIG. 12 is a perspective view of yet another lid according to another embodiment of the present disclosure.
Figure 13:
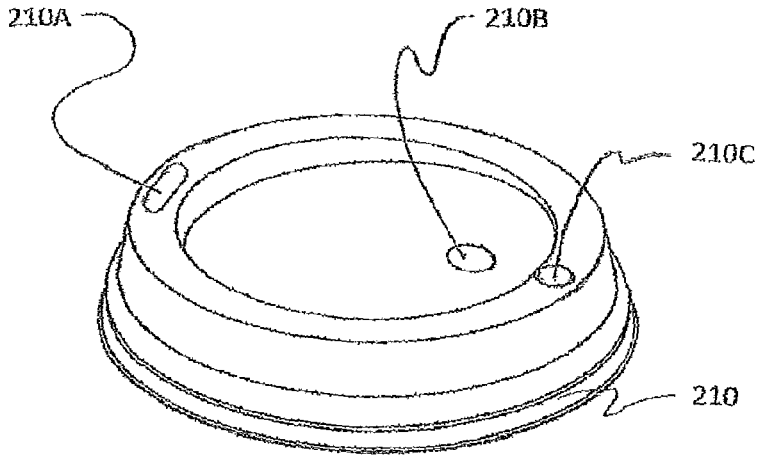
FIG. 13 is a perspective view of the lid of FIG. 12 shown with a valve thereof removed for clarity.
Figure 14:
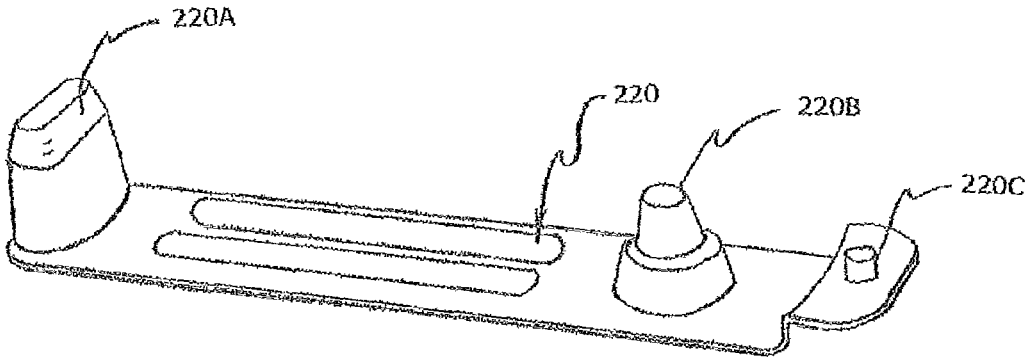
FIG. 14 is an enlarged, perspective view of the valve of the lid of FIG. 12.

With reference to FIGS. 12-14, another embodiment of a lid is illustrated and designated 200. Lid 200 includes a body 210 and a valve 220 that is directly coupled to body 210. Body 210 defines a first aperture 210*a*, a second aperture 210*b*, and a third aperture 210*c*. Valve 220 includes a first protuberance 220*a*, a second protuberance 220*b*, and a third protuberance 220*c*. Valve 220 can include one or more stiffening members 222 secured to, or integrally formed with valve 220 that function to stiffen valve. Stiffening members 222 can be positioned anywhere on valve 220. In embodiments with a plurality of stiffening members 222, one or more of the plurality of stiffening members 222 can be aligned and/or staggered relative to one another. Stiffening members 222 can be formed within valve 220 and may define a cavity 222*a* therein. Stiffening members 222 and/or one or both of protuberances 220*a*, 220*b* can be hollow, which can improve sealing with body 210 upon receiving fluid therein, e.g., by tilting fluid filled container to enable fluid to collect therein and impart fluid pressure from valve 220 to body 210.

Third protuberance 220*c* of valve 220 is secured to third aperture 210*c* of body 210, for example, by heat sealing or welding as noted above. When valve 220 is secured to body 210, valve 220 is flexibly biased towards body 210 such that second protuberance 220*b* of valve 220 engages second aperture 210*b* of body 210, and first protuberance 220*a* of valve 220 engages first aperture 210*a* of body 210. Second protuberance 220*b* is actuatable, e.g., via depression, to pivot first protuberance 220*a* about third protuberance 220*c*, away from first aperture 210*a* of body 210. In this regard, upon actuation of second protuberance 220*b* (i.e., when lid 200 is coupled to a fluid retaining cup), valve 220 pivots relative to body 210 so that air can pass into second aperture 210*b* and fluid retained in the cup can pass out of first aperture 210*a*.

Figure 15:
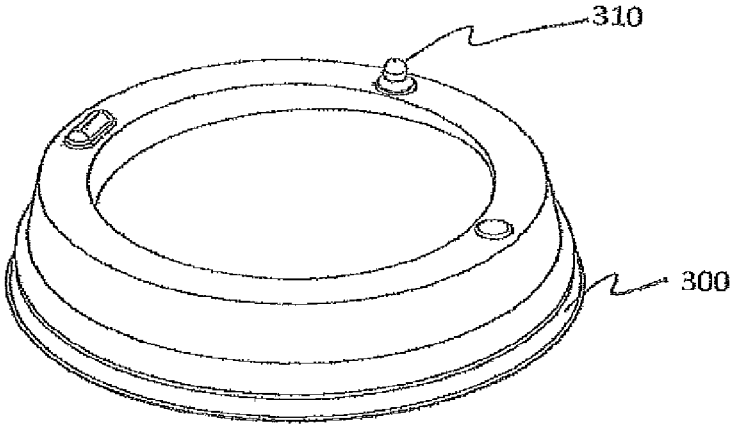
FIG. 15 is a perspective view of still another lid according to one embodiment of the present disclosure.
Figure 16:
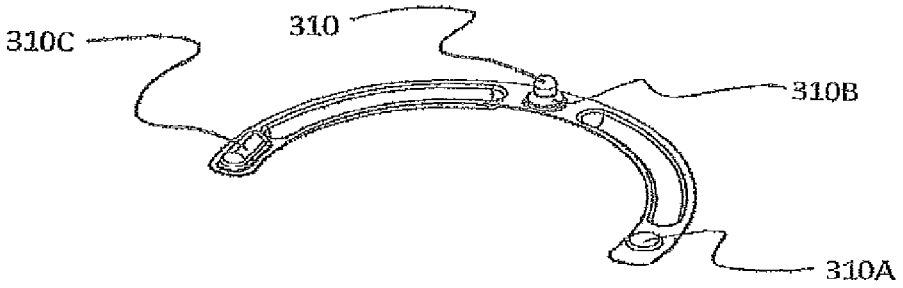
FIG. 16 is a perspective view of a valve of the lid of FIG. 15.

With reference to FIGS. 15 and 16, another embodiment of a lid is illustrated and designated 300. Lid 300 defines a plurality of apertures and includes a C-shaped valve 310. C-shaped valve 310 includes a first protuberance 310*a*, a second protuberance 310*b*, and third protuberance 310*c*. C-shaped valve 310 defines a plurality of stiffening members 312 that define a cavity 312*a* therein. Although stiffening members 312 a shown extending in a downward direction, stiffening members 312 are similar to stiffening members 222 and can project in any direction such as upwards. First protuberance 310*a* is directly secured to lid 300 so that an actuation of second protuberance 310*b* enables second and third protuberances 310*b*, 310*c* to pivot relative to first protuberance 310*a* similar to that described above with respect to lid 200 so that fluid can be dispensed through lid 300.

Figure 17:
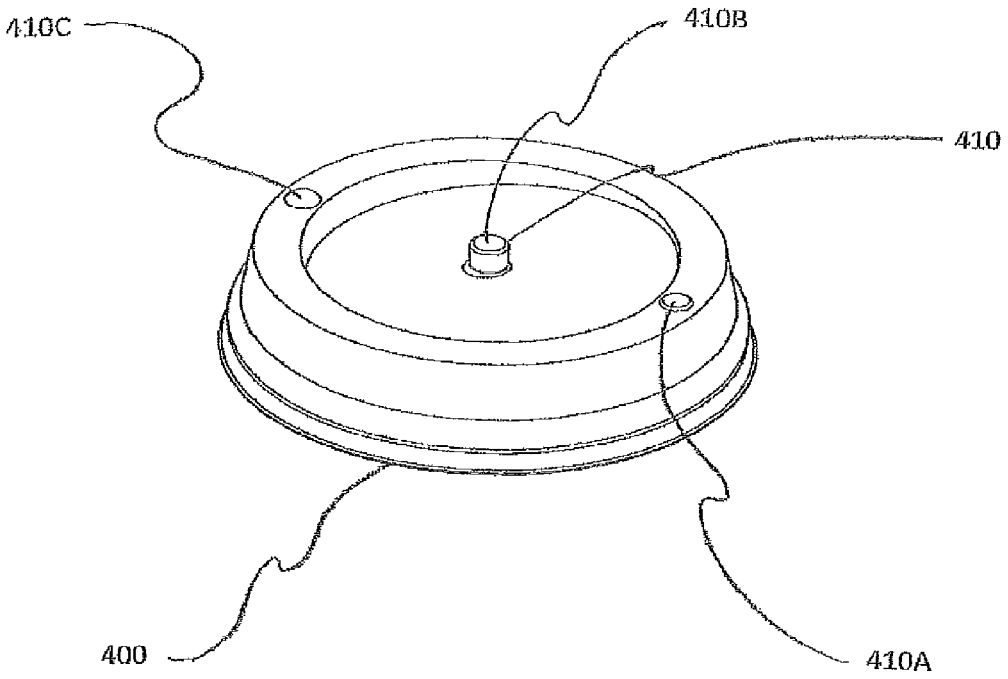
FIG. 17 is a perspective view of yet another lid according to another embodiment of the present disclosure.

Referring now to FIG. 17, still another embodiment of a lid is illustrated and designated 400. Lid 400 defines a plurality of apertures and includes a valve 410. Valve 410 includes a first protuberance 410*a*, a second protuberance 410*b* and third protuberance 410*c*. First protuberance 410*a* is directly secured to lid 400 so that an actuation of second protuberance 410*b* enables second and third protuberances 410*b*, 410*c* to pivot relative to first protuberance 410*a* similar to that described above with respect to lid 200 so that fluid can be dispensed through lid 400.

Figure 20:
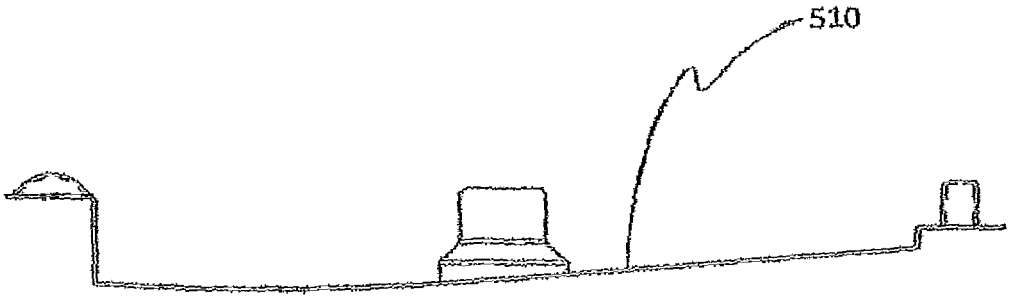
FIG. 20 is a side view of a valve of the lid of FIG. 18 prior to being secured to a body of the lid of FIG. 18.
Figure 21:
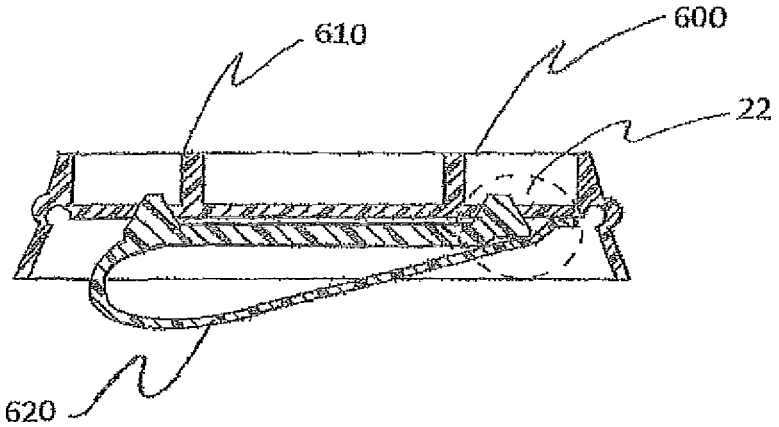
FIG. 21 is a cross-sectional view of one embodiment of a lid according to the present disclosure.
Figure 22:
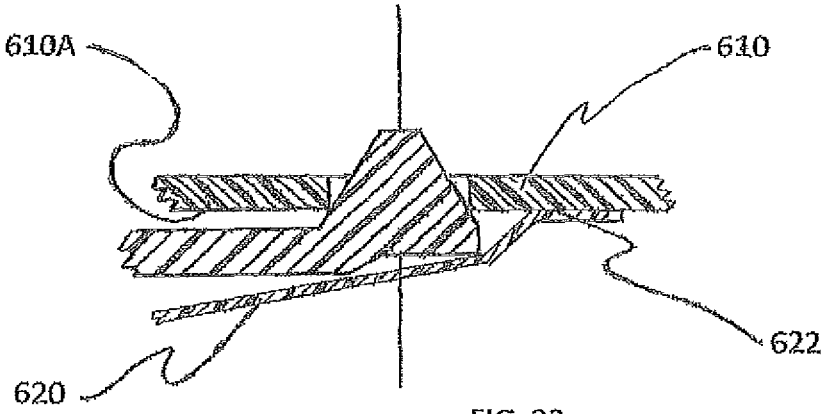
FIG. 22 is an enlarged view of the indicated area of detail shown in FIG. 21.

As illustrated in FIGS. 18-20, yet another embodiment of a lid is illustrated and designated 500. Lid 500 is substantially similar to lid 400, but includes a chevron shaped valve 510. With reference to FIGS. 21 and 22, one embodiment of a lid 600 includes a body 610 and valve 620 that is directly secured to body 610. In particular, valve 620 includes an arm 622 that is directly secured to an interior, or bottom surface 610*a*, of lid 600 such as by heat sealing, welding, adhesive, snap-fit, etc.

Figure 23:
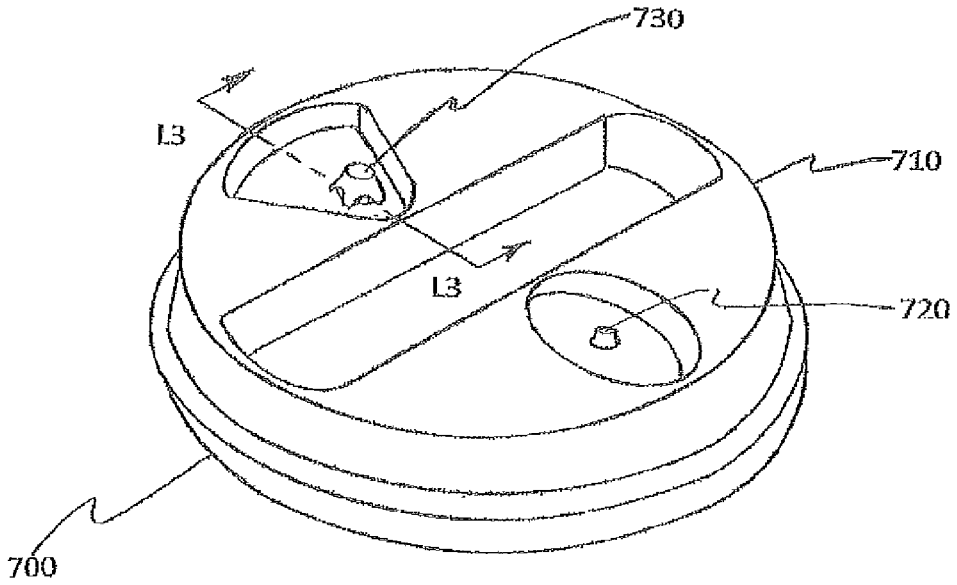
FIG. 23 is a perspective view of another embodiment of a lid according to the present disclosure.
Figure 24:
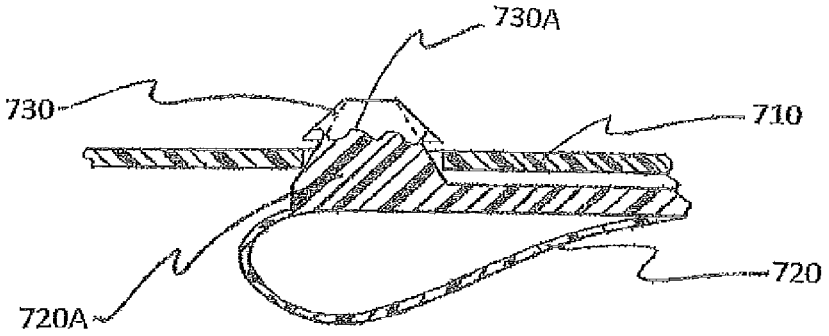
FIG. 24 is an enlarged, partial side view of the lid of FIG. 23 taken along line segment L3-L3.
Figure 25:
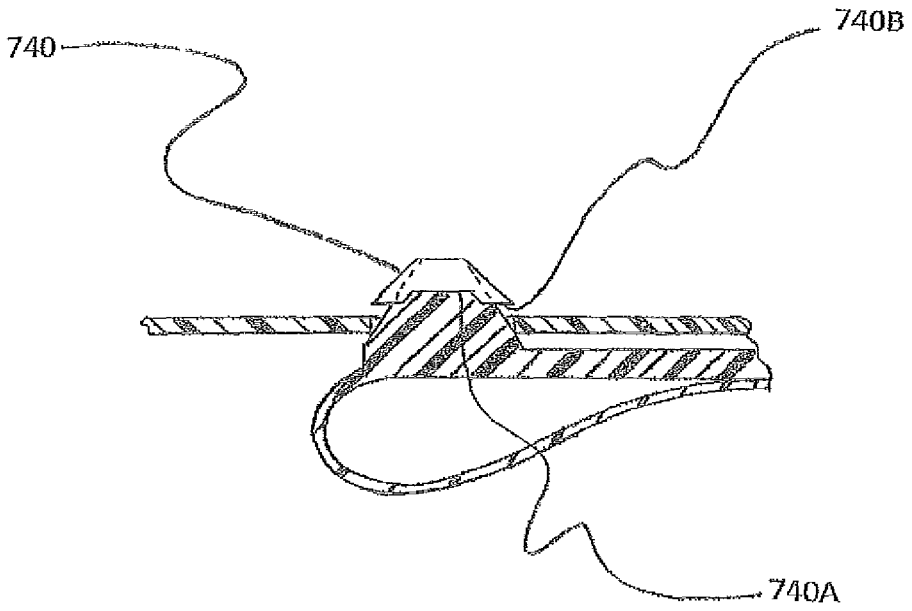
FIG. 25 is a partial side view of still another embodiment of a lid according to the present disclosure.
Figure 26:
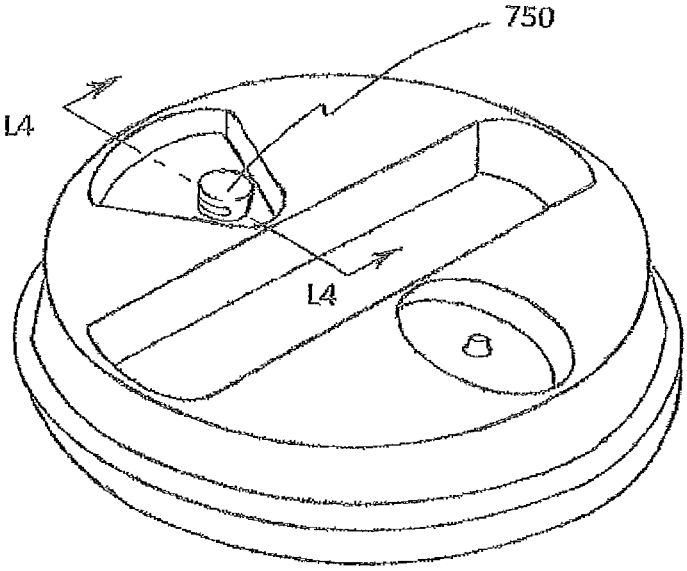
FIG. 26 is a perspective view of one embodiment of a lid according to the present disclosure.
Figure 27:
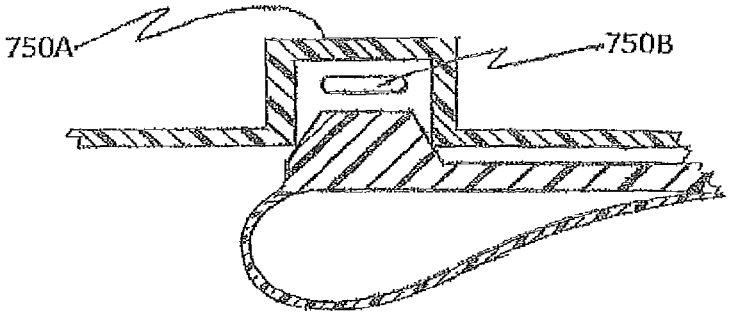
FIG. 27 is an enlarged, partial, side cross-sectional view of the lid of FIG. 26 taken along line segment L4-L4.
Figure 28:
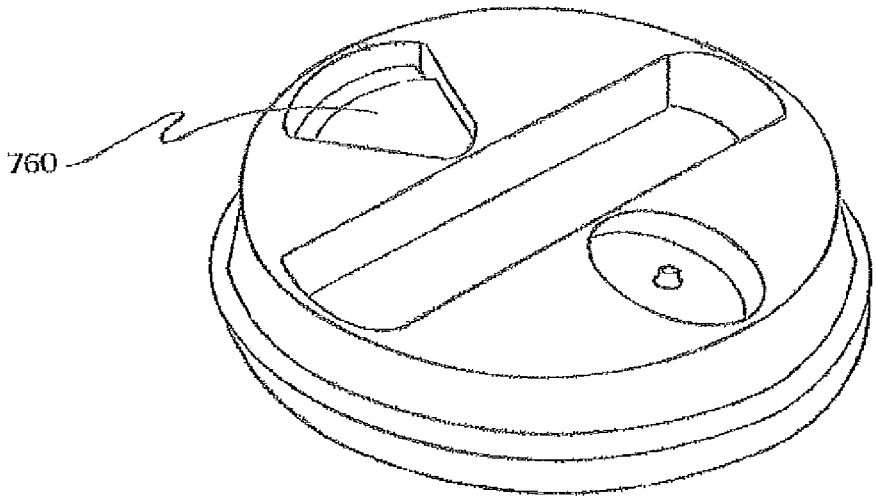
FIG. 28 is a perspective view of yet another embodiment of a lid according to the present disclosure.
Figure 29:
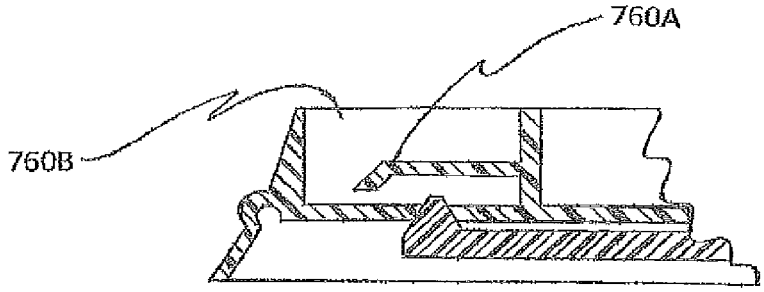
FIG. 29 is an enlarged, partial, cross-sectional side view of the lid of FIG. 28.
Figure 30:
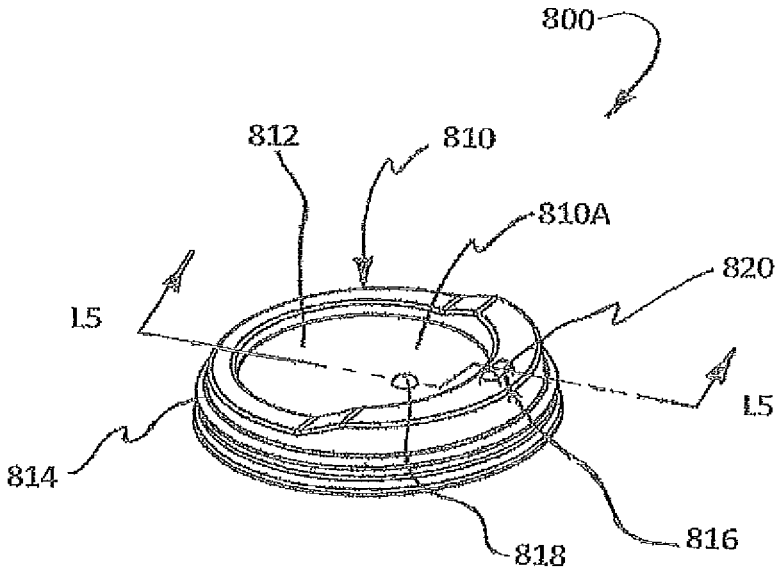
FIG. 30 is a top, perspective view of another embodiment of a lid according to the present disclosure.
Figure 31:
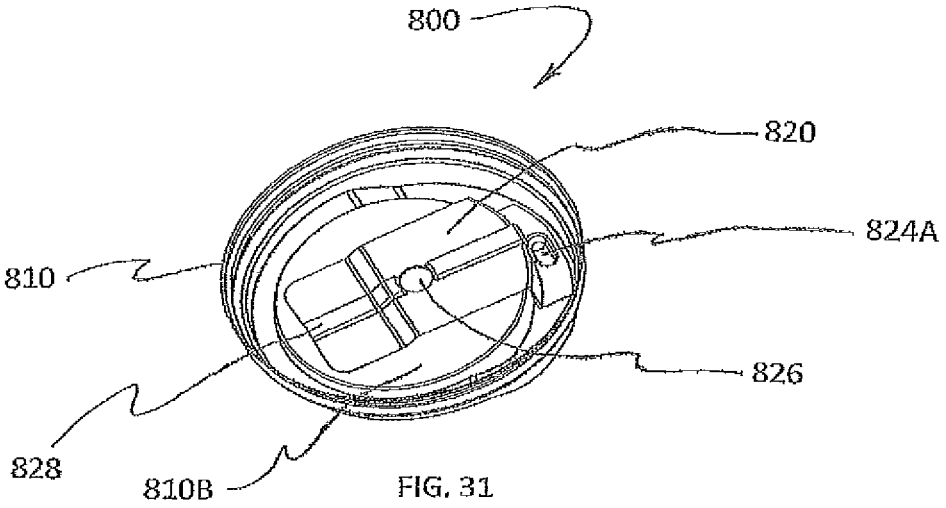
FIG. 31 is a bottom, perspective view of the lid of FIG. 30.
Figure 32:
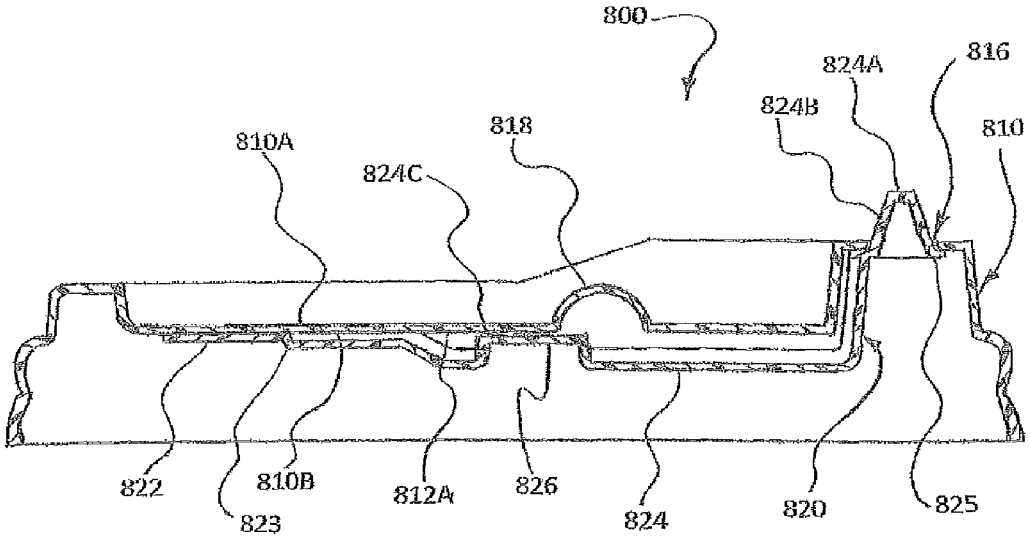
FIG. 32 is a side, cross-sectional view of the lid of FIGS. 30 and 31 as taken along line segment L5-L5 shown in FIG. 30 with a valve of the lid being shown in a free state.
Figure 33:
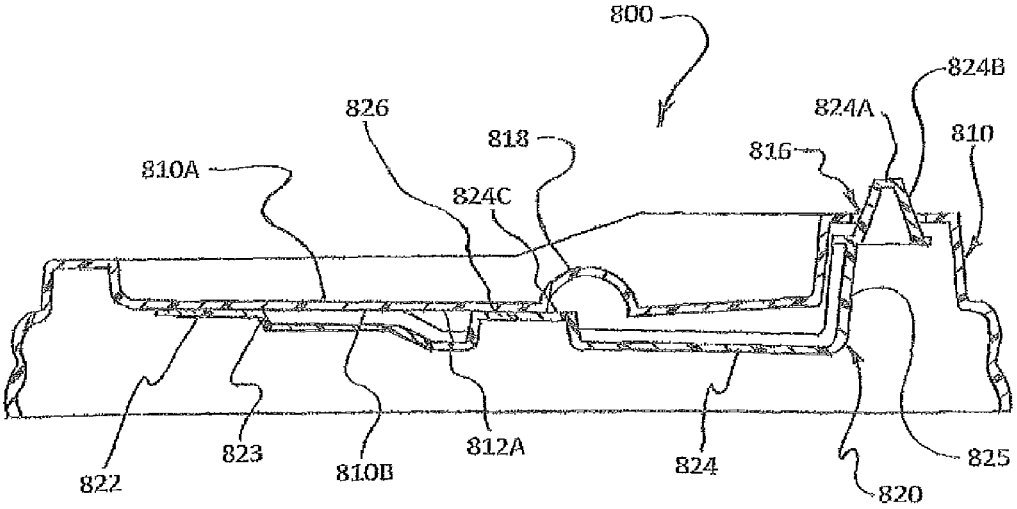
FIG. 33 is a side, cross-sectional view of the lid of FIGS. 30-32 as taken along line segment L5-L5 shown in FIG. 30 with the valve of the lid being shown in a depressed state.
Figure 34:
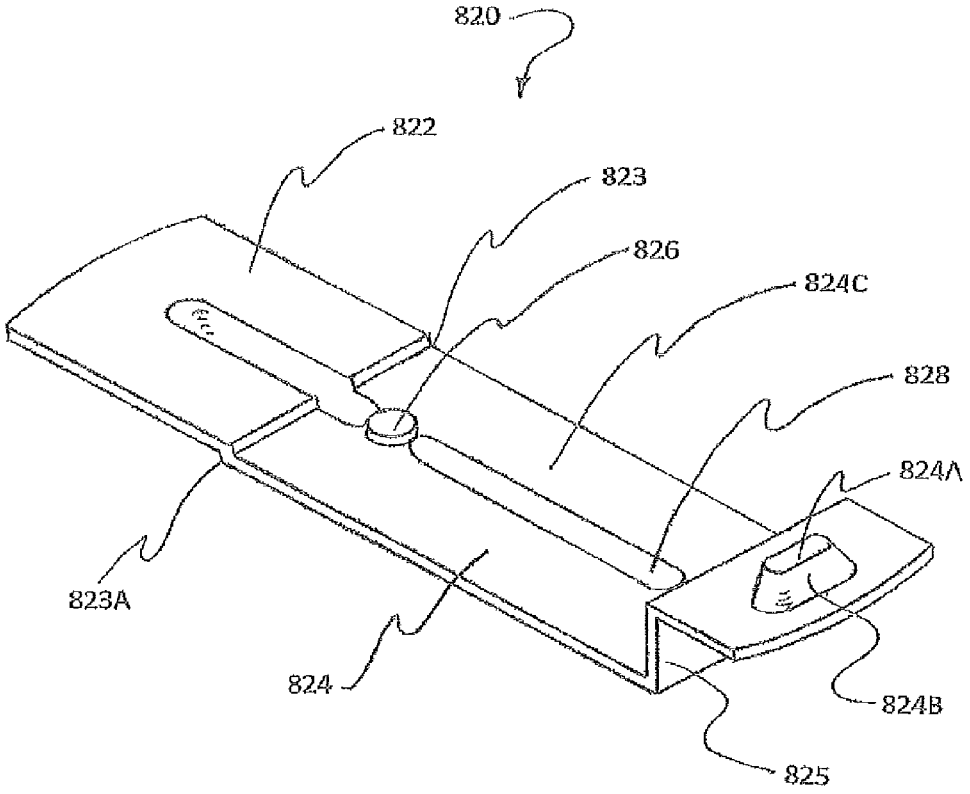
FIG. 34 is an enlarged, perspective view of the valve of the lid of FIGS. 30-33.

Referring now to FIGS. 23 and 24, still another embodiment of a lid is illustrated and designated 700. Lid 700 includes a body 710 and a valve 720. Valve 720 includes a baffle 730 that is secured thereto, and which can be monolithically formed with a protuberance 720*a* of valve 720. Lid 700 can include a baffle 730 with a sinuous flange 730*a*. As shown in FIG. 25, one embodiment of a baffle 740 defines one or more notches 740*a* and one or more stop members 740*b*. Similarly, as shown in FIGS. 26 and 27, one embodiment of a baffle 750 has a body 750*a* that defines an opening 750*b*. Also similarly, as shown in FIGS. 28 and 29, another embodiment of a baffle 760 includes an arm 760*a* and a finger 760*b* that extends from the arm 760*a*. Any of the presently disclosed baffles function to control and/or restrict fluid dispensed out of a respective one of the presently described lids.

As seen in FIGS. 30-34, yet another embodiment of a lid is illustrated and designated 800. Lid 800 includes a body member 810 and a valve 820.

Body member 810 includes a central body 812 that extends to an outer periphery 814 configured to couple to a rim of a fluid container. Body member 810 defines an aperture 816 therethrough and has a top surface 810*a* and a bottom surface 810*b*. Central body 812 includes a nub 818 that extends from top surface 810*a* of body member 810. Nub 818 may be positioned at any suitable location on central body 812 and is configured to move with central body 812. In some embodiments, nub 818 may be deflectable relative to central body 812. In certain embodiments, central body 812 has flat surface devoid of nub 818.

Valve 820 has a first portion 822 directly secured to bottom surface 810*b* of body member 810 and a second portion 824 that extends from first portion 822 and movable relative to first portion 822 and/or body member 810. In embodiments, first portion 822 may be heat sealed to bottom surface 810*b* of body member 810. In some embodiments, first portion 822 is ultrasonically welded to bottom surface 810*b* of body member 810. First and second portions 822, 824 are connected by a hinged portion 823. Hinged portion 823 may include at least one bend 823*a* to enable second portion 824 to move between a free state (FIG. 32) and a depressed state (FIG. 33) relative to first portion 822 and/or body member 810 in response to deflection of at least a portion of central body 812 of body member 810 relative to outer periphery 814 of body member 810.

Second portion 824 of valve 820 includes a ledge 825 that supports a protuberance 824*a* configured for sealed engagement with aperture 816 of body member 810 in the free state. In the depressed state, protuberance 824*a* is configured to be spaced from aperture 816 of body member 810. Although shown with an L-shape cross-section, ledge 825 can have any suitable shape and/or dimension. Protuberance 824*a* includes a tapered surface 824*b* that is disposed in aperture 816 of body member 810, and extends therethrough, while in the free state to seal aperture 816. A second protuberance 826 of second portion 824 is configured to contact bottom surface 810*b* of body member 810.

A rib 828 is positioned along at least a portion of valve 820 thereof to increase stiffness of valve 820. Valve 820 may include any number of ribs 828 along any portion thereof (or none at all). For example, valve 820 may include at least two ribs disposed in parallel relation to one another. Two or more ribs may be longitudinally aligned and/or longitudinally offset from one another.

In operation, deflection of central body 812 deflects second protuberance 826 such that second portion 824 pivots relative to first portion 822 between the free state and the depressed state. A bottom surface 812*a* of central body 812 may contact a top surface 824*c* of second portion 824 of valve 820 to move second portion 824 from the free state to the depressed state in response to deflection of central body 812. Bottom surface 812*a* of central body 812 may be spaced from top surface 824*c* of second portion 824 while second portion 824 is in the free state. Bottom surface 812*a* of central body 812 may be in contact with top surface 824*c* of second portion 824 while second portion 824 is in the depressed state. First portion 822 may be disposed transverse to second portion 824 in at least one of the free state and the depressed state. In embodiments, first portion 822 may be parallel to second portion 824 in at least one of the free state and the depressed state.

Another embodiment of a container lid 900 having a seating valve is illustrated in FIGS. 35-38. The container lid 900 includes a body member 910, a valve portion 920 and an interconnecting portion 930 and is formed as an integral one-piece work in process that is further processed to obtain the final container lid. The body member 910 and the valve portion 920 illustrated in FIGS. 35-38 function in the same manner and are structurally similar to the embodiment illustrated in FIGS. 30-34, and the description of the prior embodiment is equally applicable to the embodiment of FIGS. 35-38 noting, however, that the body member 910, the valve portion 920 and interconnecting portion 930 in the present embodiment are formed as a single unitary piece for efficiency in high volume manufacturing operations.

Figure 35:
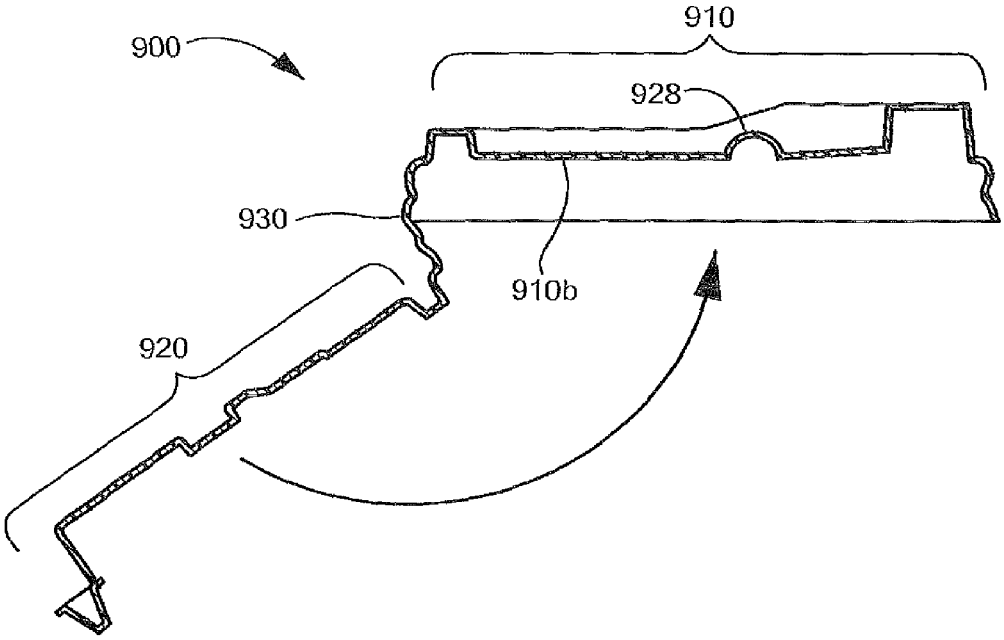
FIG. 35 is a side cross-sectional view of another embodiment of a molded container lid and valve formed as an integral unit prior to folding of the valve portion against the underside of the container lid.
Figure 36:
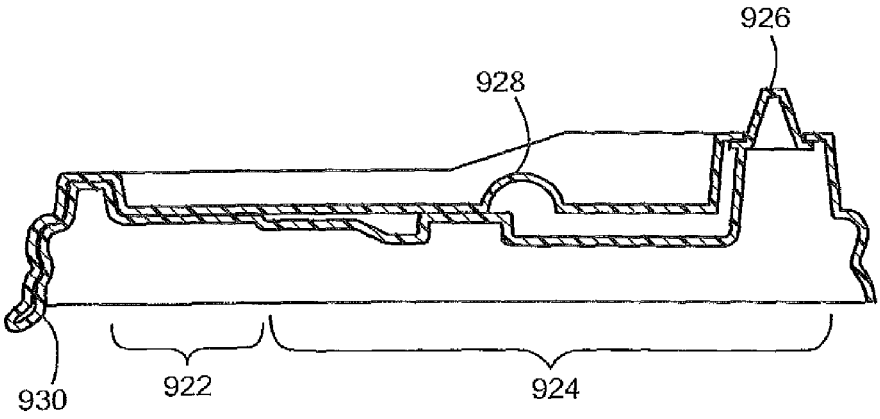
FIG. 36 is a side cross-sectional view of the lid of FIG. 35 after folding of the valve portion against the underside of the body member with the seating valve closed.
Figure 37:
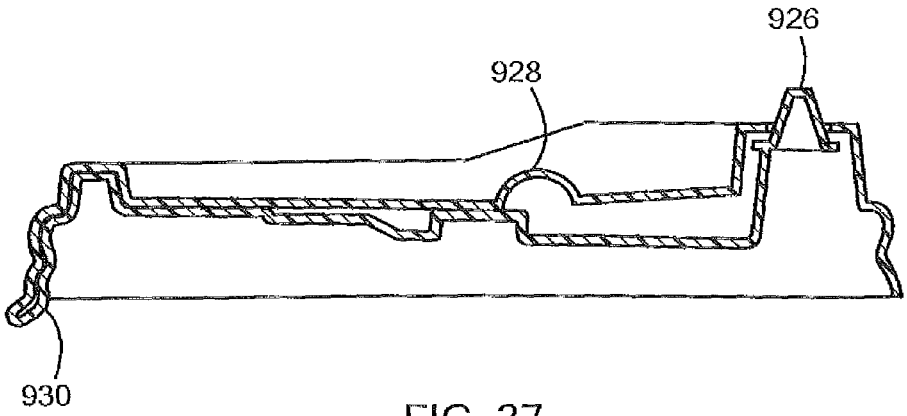
FIG. 37 is a side cross-sectional view of the container lid and valve of FIG. 35 after folding of the against the underside of the body member with the seating valve open.
Figure 38:
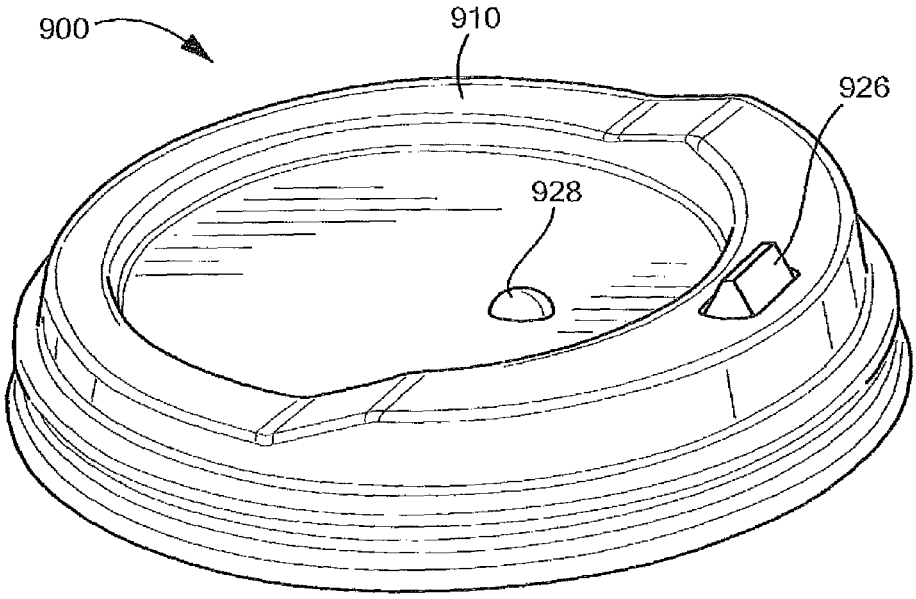
FIG. 38 is a perspective view of the lid of FIG. 37.

More specifically, in initial forming and trimming operations, a lid 900 is formed from a plastic sheet. Any plastic sheet known in the art for such forming operations may be employed. The lid 900 may be formed via a thermoforming operation or via any other suitable forming process. The body member 910 and the valve portion 920 are connected to one another by the interconnecting portion 930 as illustrated in FIG. 35.

The structure and function of the body member 910 and the valve portion 920 are the same as the structure and function of the body member 810 and the valve 820 discussed hereinabove with respect to FIGS. 31-34, noting that in the embodiment of FIGS. 35-38, body member 910 and the valve portion 920 are connected by the integral interconnecting portion 930.

After forming of the lid 900, the valve portion 920 is folded at the interconnecting portion 930 toward the underside 910*b* of the body member 910 and formed so that the valve portion 920 is disposed along the underside 910*b* of the body member 910. The valve portion 920 includes a first portion 922 that is secured to bottom surface 910*b* of the body member 910 inward of the interconnecting portion 930 at one or more points to retain the valve portion 920 generally disposed along the underside of the body member 910. The first portion 922 may be secured to the bottom surface 910*b* via heat sealing, ultrasonic welding, mechanical forming, an adhesive or any other suitable technique known in the art.

A second free end portion 924 of the valve portion 920 extends from the first portion 922 and includes a seating valve 926 in the form of a protuberance that occludes an aperture in the body member 910 to seal the aperture in the absence of pressure applied to a nub 928 projecting from the upper surface of body member 910.

Upon the application of pressure to the nub 928 from the top surface of the body member 910, the free end portion 924 is urged downward so as to cause the seating valve 926 to no longer occlude the aperture in the body member 910 as discussed hereinabove with respect to FIGS. 30-34.

Upon folding and forming the interconnecting portion 930 so that the valve portion 920 is disposed against the underside 910*b* of the body member 910, the interconnecting portion 930 is disposed in generally abutting relation to the interior peripheral surface of the underside of the body member 910 so that the lid 900 may be readily disposed over and retained on the rim or a cooperative fluid container.

Persons skilled in the art will understand that the structures and methods specifically described herein and illustrated in the accompanying figures are non-limiting exemplary embodiments, and that the description, disclosure, and figures should be construed merely as exemplary of particular embodiments. It is to be understood, therefore, that the present disclosure is not limited to the precise embodiments described, and that various other changes and modifications may be effected by one skilled in the art without departing from the scope or spirit of the disclosure. Additionally, it is envisioned that the elements and features illustrated or described in connection with one exemplary embodiment may be combined with the elements and features of another without departing from the scope of the present disclosure, and that such modifications and variations are also intended to be included within the scope of the present disclosure. Accordingly, the subject matter of the present disclosure is not to be limited by what has been particularly shown and described.

What is claimed is:

1. A lid configured for use with a cooperative fluid container having a rim, the lid comprising:

a body member formed of a deformable material and having a central body, the body member including an outer periphery terminating in a circumferential lip configured to sealably couple the lid to the rim of the fluid container upon urging of the lip over the rim, the body member defining an aperture therethrough, the body member having a top surface and a bottom surface, the central body having a top surface and a bottom surface corresponding to portions of the top surface and the bottom surface of the body member respectively, and the central body being deformable and downwardly deflectable upon the application of manual pressure to the top surface of the central body;

a valve portion formed of the deformable material, the valve portion having a first portion directly secured to the bottom surface of the body member and a second free end portion extending from the first portion, the second free end portion including a contact region and a sealing portion movable relative to the first portion between a free state and a depressed state in response to downward deflection of at least a portion of the central body relative to the outer periphery of the body member, the downward deflection of the central body causing the bottom surface of the central body to abut the contact region and urge the second free end portion and the sealing portion from the free state to the depressed state, the sealing portion configured for sealed engagement with the aperture of the body member while the second free end portion is in the free state and being spaced from the aperture of the body member while the second free end portion is in the depressed state to permit fluid flow through the aperture; and an interconnecting portion formed of the deformable material as an integral single continuous piece with the body member and the valve portion, the interconnecting portion extending between the outer periphery of the body member and the first portion of the valve portion.

2. The lid of claim 1, wherein the bottom surface of a portion of the central body contacts a top surface of the second free end portion of the valve portion to move the second free end portion from the free state to the depressed state in response to the downward deflection of the portion of the central body of the body member.

3. The lid of claim 2, wherein the bottom surface of the central body is spaced from the contact region of the top surface of the second free end portion while the second free end portion is in the free state, and wherein the bottom surface of the central body is in contact with the contact region of the second free end portion while the second free end portion is in the depressed state.

4. The lid of claim 1 including a nub upwardly projecting upward from a portion of the central body, the nub being downwardly deflectable relative to the outer periphery of the body member to move the second free end portion from the free state to the depressed state.

5. The lid of claim 1 wherein the valve portion includes at least one rib along a portion thereof.

6. The lid of claim 5 wherein the valve portion includes at least two ribs disposed in parallel relation.

7. The lid of claim 1 wherein the first portion and second free end portion of the valve portion are connected by a hinged portion.

8. The lid of claim 7 wherein the hinged portion includes at least one bend to orient the second free end portion relative to the first portion.

9. The lid of claim 8 wherein the first portion is disposed transverse to the second free end portion in at least one of the free state and the depressed state.

10. The lid of claim 8 wherein the first portion is parallel to the second free end portion in at least one of the free state and the depressed state.

11. The lid of claim 1 wherein the sealing portion includes a protuberance extending from the second free end portion.

12. The lid of claim 11 wherein the protuberance includes a tapered surface, the tapered surface being disposed in the aperture of the body member while the second free end portion of the valve portion is in the free state to seal the aperture.

13. The lid of claim 12 wherein the tapered surface extends through the aperture of the body member in the free state.

14. The lid of claim 1 wherein the first portion is heat sealed to the bottom surface of the body member.

15. The lid of claim 1 wherein the first portion is ultrasonically welded to the bottom surface of the body member.

16. The lid of claim 1 wherein the contact region of the second free end portion is configured such that the second free end portion pivots relative to the first portion between the free state and the depressed state upon downward deflection of the central body.

17. The lid of claim 1 wherein at least a portion of the interconnecting portion is disposed in conforming confronting engagement with the bottom surface of the outer periphery of the body member so as to permit the lid to be disposed on the rim of the fluid container.

18. The lid of claim 1 wherein the deformable material is a deformable plastic material.

19. A lid configured for use with a cooperative fluid container having a rim, the lid comprising:

a body member formed of a deformable material, the body member having a top surface and a bottom surface and including a central body, the body member extending to an outer periphery having a circumferential lip, the circumferential lip being configured to sealably couple the lid to the rim of the fluid container upon urging of the lip over the rim, the body member defining an aperture therethrough adjacent the outer periphery, the central body having a top surface and a bottom surface corresponding to portions of the top surface and the bottom surface of the body member respectively, and the central body being deformable and downwardly deflectable upon the application of manual pressure to the top surface of the central body;

a valve formed of the deformable material, the valve including an aperture sealing portion, the valve being fixedly secured to the bottom surface of the body member, the valve being configured such that the aperture sealing portion occludes the aperture in the absence of manual pressure applied to the top surface of the central body and configured such that the aperture sealing portion is spaced from the aperture in response to the application of manual downward pressure to the top surface of the central body so as to permit fluid flow through the aperture; and an interconnecting portion extending between the outer periphery of the body member and the valve, wherein the body member, the interconnecting portion and the valve are formed of the same deformable material as an integral continuous unitary structure.

20. The lid of claim 19 wherein the deformable material is a plastic material.

21. A lid configured for use with a cooperative fluid container having a rim, the lid comprising:

a body member formed of a deformable material, the body member having a top surface and a bottom surface, the body member including a central body, the body member having an outer periphery terminating in a circumferential lip, the circumferential lip configured to sealably couple the lid to the rim of the fluid container upon urging of the lip over the rim, the body member defining an aperture therethrough adjacent the outer periphery, the central body having a top surface and a bottom surface corresponding to portions of the top surface and the bottom surface of the body member respectively and, the central body being deformable and downwardly deflectable upon the application of manual pressure to the top surface of the central body; and a valve having a first portion permanently secured to the bottom surface of the body member and a second portion distinct from and extending from the first portion, the second portion including a contact region adjacent the bottom surface of the central body and a sealing portion, the valve having a free state occurring in the absence of downward manual pressure applied to the top surface of the central body in which the sealing portion of the second portion occludes and thereby substantially seals the aperture, and the valve having a depressed state occurring in response to the application of downward manual pressure applied to the top surface of the central body and resulting downward deflection of the central body in which the bottom surface of the central body abuts the contact region of the second portion to urge the sealing portion downward and away from the aperture so that the sealing portion is spaced from and does not occlude the aperture.

* * * * *